US009373909B2

(12) United States Patent
Salomon et al.

(10) Patent No.: US 9,373,909 B2
(45) Date of Patent: Jun. 21, 2016

(54) CONNECTORS

(71) Applicants: Hypertronics Corporation, Hudson, MA (US); Interconnect Devices, Inc., Kansas City, KS (US)

(72) Inventors: David E. Salomon, Southborough, MA (US); Francesco A. Nania, Clinton, MA (US); Timothy E. Marshall, Shawnee, KS (US); Donald A. Marx, Olathe, KS (US)

(73) Assignees: Hypertronics Corporation, Hudson, MA (US); Interconnect Devices, Inc., Kansas City, KS (US)

( * ) Notice: Subject to any disclaimer, the term of this patent is extended or adjusted under 35 U.S.C. 154(b) by 0 days.

(21) Appl. No.: 14/746,661

(22) Filed: Jun. 22, 2015

(65) Prior Publication Data

US 2015/0372414 A1 Dec. 24, 2015

Related U.S. Application Data

(60) Provisional application No. 62/015,356, filed on Jun. 20, 2014.

(51) Int. Cl.

| | |
|---|---|
| ***H01R 13/40*** | (2006.01) |
| ***H01R 13/24*** | (2006.01) |
| ***H01R 13/453*** | (2006.01) |
| ***H01R 13/627*** | (2006.01) |
| *H01R 13/52* | (2006.01) |

(52) U.S. Cl.

CPC ..... *H01R 13/2421* (2013.01); *H01R 13/4538* (2013.01); *H01R 13/6273* (2013.01); *H01R 13/5224* (2013.01)

(58) Field of Classification Search

CPC ..... H01R 13/521; H01R 13/2421; H01R 13/6273; H01R 13/4538; H01R 13/5224; H01R 13/52

USPC ..... 439/587–589, 909

See application file for complete search history.

(56) References Cited

U.S. PATENT DOCUMENTS

| | | | | |
|---|---|---|---|---|
| 4,560,219 | A * | 12/1985 | Chapelot | H01R 13/5221 439/272 |
| 2002/0077004 | A1 | 6/2002 | Lawrence | |
| 2003/0007738 | A1 | 1/2003 | Cairns et al. | |
| 2005/0091753 | A1 | 5/2005 | Salvatini et al. | |
| 2007/0270001 | A1 | 11/2007 | Matsumura | |
| 2011/0165793 | A1 | 7/2011 | Zhou | |

* cited by examiner

*Primary Examiner* — Javaid Nasri
(74) *Attorney, Agent, or Firm* — Snell & Wilmer LLP

(57) ABSTRACT

A connector includes a receptacle having a body defining apertures and having a mating face and socket contacts each defining an opening aligned with an aperture. The connector also includes a plug having an outer casing defining a cavity and having a mating end and contacts positioned within the cavity and coupled to the outer casing, each having a pin tip. The plug also includes a pin protection plate slidably coupled to the outer casing, enclosing at least a portion of each contact within the cavity, and defining pin guides each aligned with one of the contacts. When the mating end is aligned with the mating face and force is applied to the outer casing towards the body, the pin protection plate slides into the cavity and the pin tip of the contacts extends beyond the pin protection plate into a socket contact via one of the apertures.

28 Claims, 21 Drawing Sheets

CONNECTORS

CROSS REFERENCE TO RELATED APPLICATIONS

This application claims the benefit and priority of U.S. Provisional Application No. 62/015,356, entitled "Connectors," filed on Jun. 20, 2014, the entire contents of which are hereby incorporated by reference herein.

BACKGROUND

1. Field

The present invention describes connectors for connecting two components and, more particularly, to water resistant connectors for forming a resilient connection.

2. Description of the Related Art

Connectors are used in various types of systems. It is always desirable to prevent liquids (and debris) from flowing into connectors because, over time, any liquid that enters a plug or a receptacle may corrode or otherwise damage the internal components. Some connectors are used in medical settings, such as hospitals, to connect devices, such as an MRI device or an X-ray device, to computing systems. Connectors for these types of equipment can be costly and, thus, it is especially desirable to prevent liquids from flowing into and damaging these costly connectors. Another desirable quality for connectors used in medical equipment is the ability to easily clean the connectors, especially a receptacle coupled to a bed or table, due to the highly sanitary nature of medical settings.

It is also desirable for connectors to remain in electrical connection in response to a disturbance causing movement of a plug relative to a socket. This, also, is especially true in medical settings as some imaging procedures may take a significant amount of time to complete and a significant amount of time may be lost if contacts of a plug momentarily separate from contacts of a receptacle. Connectors used in some medical settings may have a greater tendency to be subjected to disturbances due to the placement of the connectors. For example, in MRI systems, the connectors may be placed on a patient's bed such that a slight movement of the patient can potentially disconnect the plug from the receptacle.

In various systems, operators may be required to plug and unplug the connectors many times per day, such as in MRI systems where a coil may be replaced after nearly every scan. After sufficient repetitions of this plugging and unplugging, the operator may have a tendency to develop a repetitive motion injury. This is especially true if the amount of force required to unplug the connectors is relatively large. Thus, it is desirable for the connector to be easy to connect and disconnect.

Thus, a need exists in the art for connectors that tend to remain connected during disturbances, are relatively easy to clean, and require relatively little force to disconnect.

SUMMARY

This Summary is included to introduce, in an abbreviated form, various topics to be elaborated upon below in the Detailed Description.

What is described is connector for use in an environment that is exposed to liquids or debris. The connector includes a receptacle having a body defining a plurality of apertures and having a mating face and a plurality of socket contacts each defining an opening aligned with one of the plurality of apertures. The connector also includes a plug having an outer casing defining a cavity and having a mating end and a plurality of contacts positioned within the cavity and coupled to the outer casing, each having a pin tip. The plug also includes a pin protection plate slidably coupled to the outer casing, enclosing at least a portion of each of the plurality of contacts within the cavity, and defining a plurality of pin guides each aligned with one of the plurality of contacts. When the mating end of the outer casing is aligned with the mating face of the pin protection plate and force is applied to the outer casing towards the body, the mating face resists movement of the pin protection plate and the pin tip of each of the plurality of contacts extends beyond the pin protection plate and is received by one of the plurality of socket contacts via one of the plurality of apertures of the body.

Also described is a connector for use in an environment exposed to liquids or debris. The connector includes a receptacle configured to be coupled to a surface and having a body defining a plurality of apertures and having a mating face. The receptacle also includes a plurality of socket contacts each defining an opening aligned with one of the plurality of apertures and having a termination end having at least one of a pin tip, a spring probe, or a contact surface. The connector also includes a plurality of bed contacts each including at least one of bed socket contact, a target contact, a plated through hole, or a bed contact surface. The connector also includes a plug having an outer casing defining a cavity and having a mating end. The plug also includes a plurality of contacts positioned within the cavity and coupled to the outer casing, each having a pin tip configured to be received by the opening of one of the plurality of socket contacts.

Also described is a connector for use in an environment exposed to liquids or debris. The connector includes a receptacle having a receptacle casing defining a plurality of contact apertures and having a mating surface. The receptacle also includes a plurality of target contacts each having a contact surface and positioned in one of the plurality of contact apertures such that the contact surface is flush with the mating surface. The connector also includes a plug having a plug casing defining a cavity and an insulator positioned with the cavity, coupled to the plug casing, having a mating face, and defining a plurality of probe apertures. The plug also includes a plurality of spring probes each coupled to the insulator, having a mating end, and extending through one of the plurality of probe apertures such that the mating end extends outward from the mating face.

Also described is a connector for use in an environment exposed to liquids or debris. The connector includes a receptacle having a receptacle casing having a mating surface, defining a plurality of contact apertures, and defining a first receiving slot and a second receiving slot. The receptacle also includes a plurality of receptacle contacts each having a mating end and a termination end and positioned in one of the plurality of contact apertures. The connector also includes a plug having a plug casing defining a cavity and a plurality of plug contacts each positioned within the cavity, coupled to the plug casing, and having a mating end configured to mate with the mating end of one of the plurality of receptacle contacts. The plug also includes a latch actuation collar positioned within the cavity and slidably coupled to the plug casing. The plug also includes two latches each in contact with the latch actuation collar and having a receptacle lip configured to be received by one of the first receiving slot or the second receiving slot. When the plug is connected to the receptacle and the latch actuation collar is moved relative to the plug casing, the receptacle lip of each of the two latches is removed from the corresponding one of the first receiving slot or the second receiving slot.

BRIEF DESCRIPTION OF THE DRAWINGS

The features, obstacles, and advantages of the present invention will become more apparent from the detailed description set forth below when taken in conjunction with the drawings, wherein.

DETAILED DESCRIPTION

Apparatus, systems, and/or methods that implement the embodiments of the various features of the present invention will now be described with reference to the figures. The figures and the associated descriptions are provided to illustrate some embodiments of the present invention and not to limit the scope of the present invention. Throughout the drawings, reference numbers are re-used to indicate correspondence between referenced elements. A connection, when mentioned in this document, may refer to any communication channel between modules, and the communications may occur via a wired connection, a wireless connection, or a combination of the two.

Figure 1:
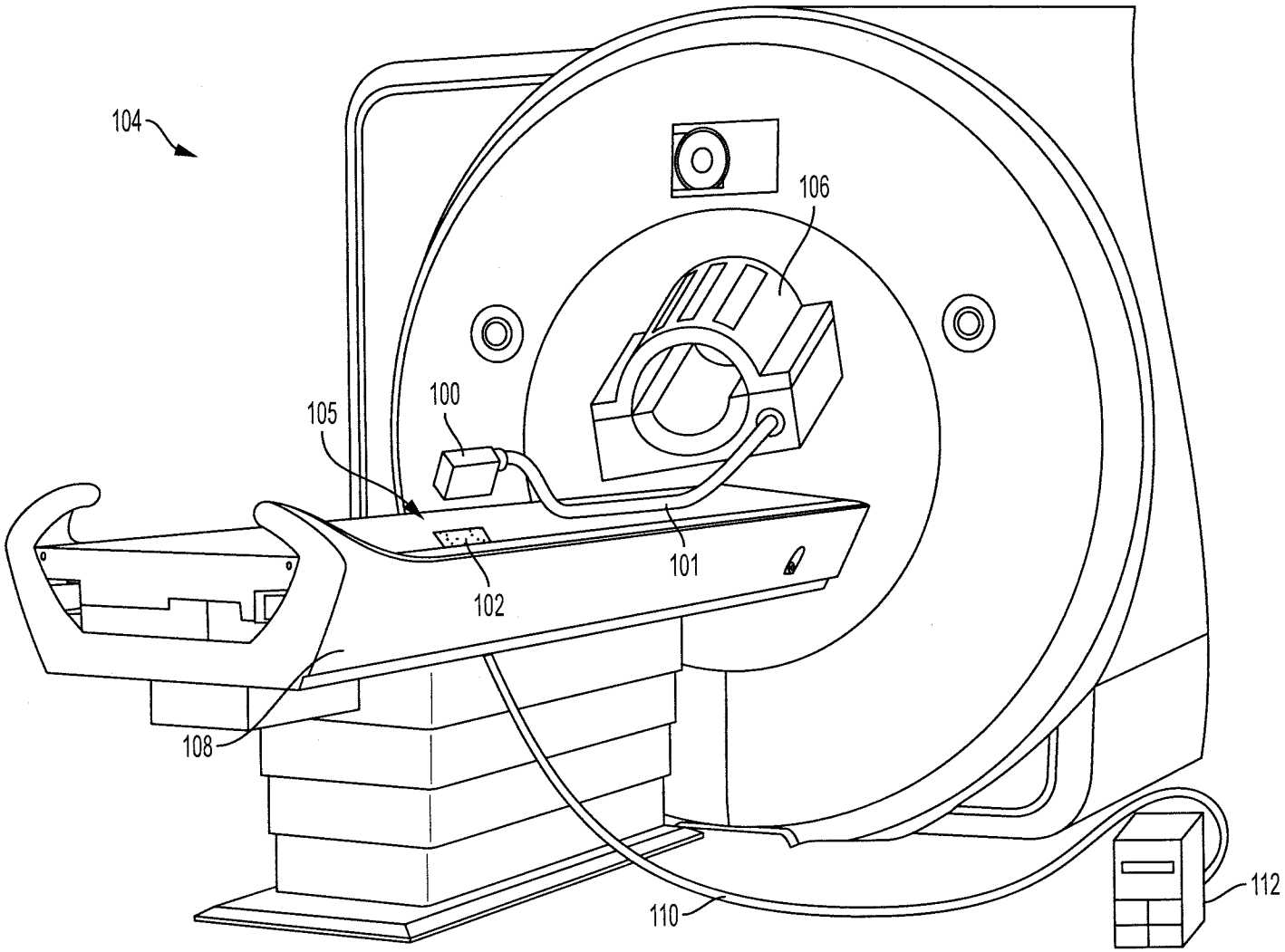
FIG. 1 illustrates an imaging system that includes a coil connected to a computing system via a connector that includes a plug and a receptacle according to one or more embodiments described herein.

FIG. 1 illustrates an imaging system 104. The imaging system 104 may be capable of detecting one or more types of image data, such as X-ray image data, magnetic resonance imaging (MRI) image data, or the like. In that regard, the imaging system 104 may include a coil 106, a computing device 112, and a bed (or table) 108. The coil 106 may be a coil for an MRI device, an X-ray detector, an X-ray signal generator, or the like. The imaging system may include a plurality of coils designed for use with various body parts. For example, the coil 106 may be designed to be used for obtaining imaging corresponding to a user's limb. Because of the variety of coils, they may frequently be swapped out for another coil better adapted for a particular body part. Thus, easy-to-use connectors are desirable for connecting the various coils to the computing device 112.

A patient may be positioned on the bed 108 and the coil 106 may be positioned such that the coil 106 can detect images corresponding to a body part of the patient. In various embodiments, the imaging system 104 may not include the bed 108 and may instead include a chair for the patient to sit, a shelf for a patient's body part, or even no resting device for the patient.

The coil 106 may be coupled to a plug 100 via a cable 101. The plug 100 may receive the detected imaging data from the coil 106 via the cable 101. The bed 108 or another surface may include a receptacle 102 configured to receive the plug 100 such that the imaging data can be transferred from the plug 100 to the receptacle 102. In that regard, the plug 100 and the receptacle 102 together may be referred to as a connector 105. The receptacle 102 may be coupled to a cable 110 that is also connected to the computing device 112.

In some embodiments, the connector 105 may be used in systems other than imaging systems. For example, the connector 105 may be used in networking systems, computing systems, or any other type of systems in which data transfer occurs. Thus, where used herein, a bed may refer to any structure to which a receptacle is to be coupled.

Figure 2:
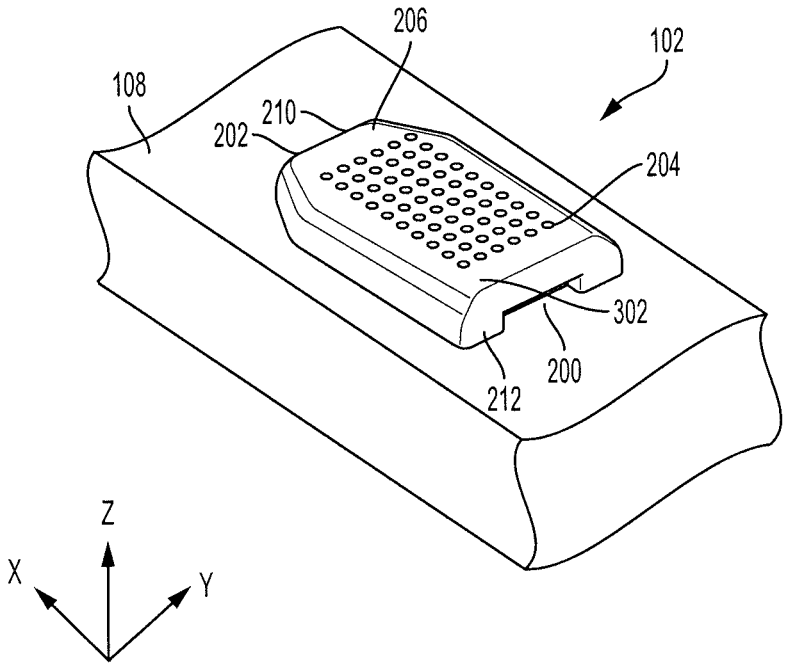
FIG. 2 illustrates the receptacle of FIG. 1 coupled to a bed and including target contacts according to one or more embodiments described herein.

With reference now to FIG. 2, an X-Y-Z axis is shown throughout the drawings to more clearly illustrate the relative positioning of components. The receptacle 102 may be permanently or removably coupled to the bed 108 and may include a receptacle casing 206 and a plurality of target contacts 204. The receptacle casing 206 may define a plurality of contact apertures 300, including a contact aperture 301, extending through the receptacle casing such that one of the plurality of target contacts 204 may extend from a mating surface 302 of the receptacle casing 206 into or through one of the contact apertures 300 defined by the receptacle casing 206. In that regard, the casing 206 functions as an insulator between each of the plurality of target contacts 204. In some embodiments, the receptacle casing 206 may instead define a cavity and include an insulator (not shown) therein such that the contact apertures 300 extend through the mating surface 302 and the insulator.

The receptacle casing 206 defines a first receiving slot 200 on a forward end 210 of the receptacle casing 206 and a second receiving slot 202 on a back end 212 of the receptacle casing 206. The forward end 210 and the back end 212 may be substantially perpendicular to the mating surface 302, meaning that an angle between the mating surface 302 and either of the forward end 210 and the back end 212 may be an acute, an obtuse, or a right angle. The mating surface 302 may be connected to one or both of the forward end 210 and the back end 212 at an angle or via a curvature. In some embodiments, the receptacle casing 206 may have receiving slots at different locations than shown in FIG. 2.

The forward end 210 of the receptacle casing 206 may be tapered. With brief reference to FIGS. 2 and 5, the plug 100 may have a forward end 501 that is also tapered in a similar manner as the forward end 210 of the receptacle casing 206. Due to the tapered ends of the plug 100 and the receptacle 102, the receptacle 102 may only receive the plug 100 in the proper orientation (i.e., when the tapered ends are aligned). This configuration, along with use of a spring probe and target contact junction (which requires less guidance than pin and socket contact junctions) ensures that when the plug 100 is received by the receptacle 102, each of the contacts within the plug 100 is aligned with the correct target contact of the receptacle 102 without having to visually guide the plug 100 to the receptacle 102.

Figure 3:
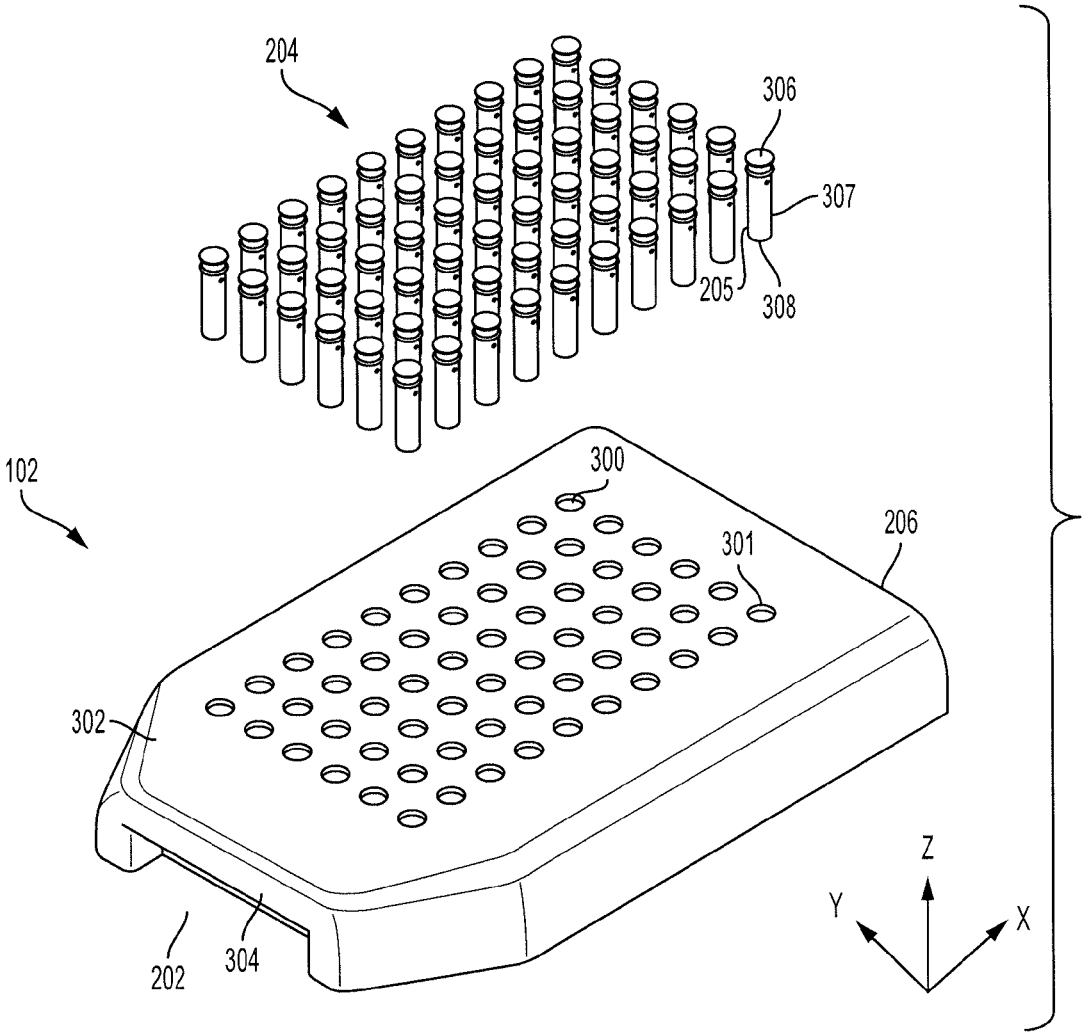
FIG. 3 is an exploded view illustrating components of the receptacle of FIG. 1 according to one or more embodiments described herein.

With reference now to FIG. 3, the plurality of target contacts 204 may include a target contact 205. The target contact 205 may include a contact body 307 that extends through the contact aperture 301 and may include a mating surface 306 at a first end of the target contact 205 and a termination end 308. The target contacts 204, as with other contacts described herein, may comprise a conductive material, such as any of a variety of metals or metal alloys. The mating surface 306 may be substantially planar and may have a circular shape or any other shape. A diameter of the mating surface 306 may be larger, smaller, or the same as any radial diameter (relative to a longitudinal axis of the target contact 205) of the contact body 307. When the plurality of target contacts 204 are positioned within the receptacle casing 206, the mating surface of each of the plurality of target contacts 204 (such as the mating surface 306 of the target contact 205) may be flush with the mating surface 302 of the receptacle casing 206, allowing for easy cleaning of the receptacle 102. For example, in order to remove debris from the receptacle 102, a user may wipe down the mating surface 302 of the receptacle casing 206, removing debris from both the mating surface 302 of the receptacle casing 206 and the mating surfaces of the target contacts 204.

The contact body 307 of the target contact 205 may have a diameter similar to the diameter of the contact aperture 301. Accordingly, the target contact 205 may be held in place relative to the receptacle casing 206 by static friction between the contact body 307 and the receptacle casing 206. The target contact 205 may also include a barb to resist movement of the target contact 205 relative to the receptacle casing 206. Barbs will be discussed in greater detail with reference to FIG. 4A below.

In some embodiments, a portion of a target contact near the contact surface may have a cylindrical shape having a larger diameter than the contact body. Accordingly, the contact surface may match a counter-bored contact aperture of a receptacle casing.

Figure 4A:
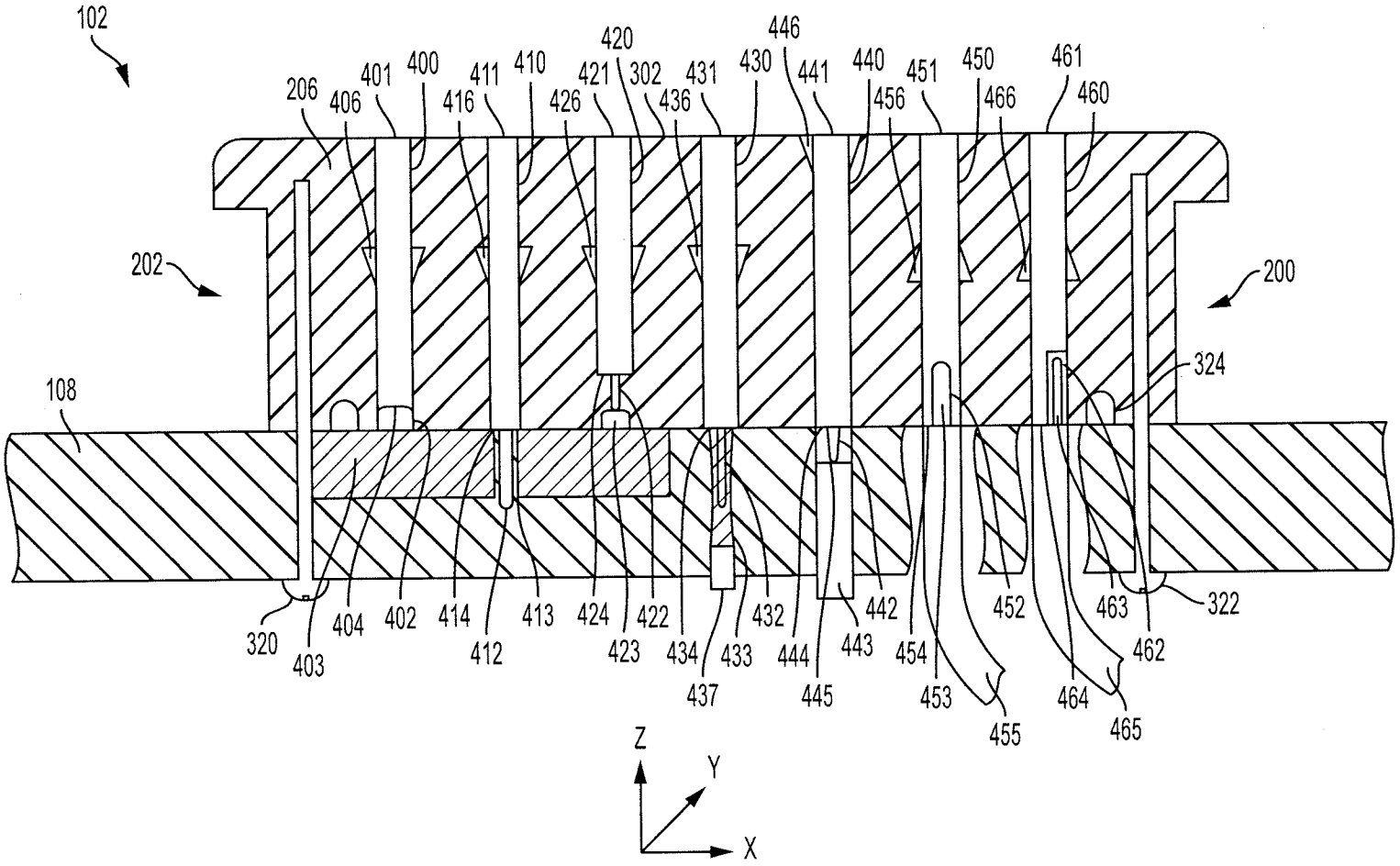
FIG. 4A is a cross-sectional view of the receptacle of FIG. 1 illustrating a face seal and target contacts having various termination styles according to one or more embodiments described herein.

With reference now to FIG. 4A, in some embodiments, the receptacle 102 may be coupled to the bed 108 via one or more mounting screws including a mounting screw 320 and a mounting screw 322. The mounting screws 320 and 322 may be driven through the bed 108 and into a portion of the receptacle casing 206. In various embodiments, the receptacle casing 206 may define one or more threaded holes (not shown) for receiving the mounting screws. Caps can be used to cover the screw heads to maintain easy cleaning of the receptacle 102. When the mounting screw 320 and the mounting screw 322 are in place, the receptacle 102 may be removably coupled to the bed 108.

With reference now to FIGS. 3 and 4A, the receptacle 102 may also include a face seal 324 surrounding the plurality of target contacts 204. The face seal 324 may include, for example, a gasket that is compressed when the receptacle casing 206 is coupled to the bed 108. Because the face seal 324 surrounds the plurality of target contacts 204, the likelihood of liquid reaching the target contacts 204 is reduced because the face seal 324 seals the target contacts 204 from moisture. In various embodiments, the face seal 324 may further include an adhesive material to aid in forming the seal between the face seal 324 and the bed 108.

Returning reference to FIG. 4A, the receptacle 102 may include target contacts having one of a variety of termination styles. While various termination styles are illustrated within the receptacle 102, one skilled in the art will realize that the receptacle 102 will typically include target contacts having a single termination style.

A target contact 400 may include a mating surface 401 and a surface mount feature, such as a contact surface, on a termination end 404. The contact surface may be soldered to a PC pad 402 of a PC board (PCB) 403, creating an electrical connection. The PCB 403 may have another contact in electrical communication with the PC pad 402 and coupled to a wire or sub-cable. The PCB 403 may be positioned on top of, or within, the bed 108. The target contact 400 may include a barb 406. The barb 406 is oriented such that the target contact 400 can be inserted into the receptacle casing 206 from the positive Z direction, as the barb is tapered towards the termination end 404. In that regard, after the target contact 400 is pressed into the receptacle casing 206, the barb 406 may reduce the likelihood of the target contact 400 becoming removed from the positive Z direction.

The target contacts may also include a target contact 410 having a contact surface 411 and a PC tail 412 extending from a termination end 414. The PC tail 412 may extend through a through-hole 413 of the PCB 403 that is plated with a conductive material. In that regard, when the PC tail 412 is positioned within the through-hole 413, solder may be applied, electrically (and mechanically, to an extent) coupling the PC tail 412 to the plating of the through-hole 413 and, thus, to the PCB 403. The target contact 410 may also include a barb 416 configured similarly to the barb 406.

The target contacts may also include a target contact 420 having a contact surface 421 and a spring probe 422 extending from a termination end 424. Characteristics and operation of spring probes will be described in greater detail below with reference to FIG. 7A. Force may be applied to the spring probe 422 towards the bed 108 such that the spring probe 422 contacts a contact surface 423 of the PCB 403, creating an electrical connection. The target contact 420 may also include a barb 426 configured similarly to the barb 406.

The target contacts may also include a target contact 430 having a contact surface 431 and a PC tail 432, similar to the PC tail 412, extending from a termination end 424. However, instead of being soldered to a plated through-hole, the PC tail 432 may be received by a socket of a contact, such as a hyperboloid socket of a hyperboloid socket contact 433 or any other type of socket, such as a bifurcated socket, creating an electrical connection. Hyperboloid sockets will be described in greater detail below with reference to FIG. 9. The hyperboloid socket contact 433, or a termination end 437 of the hyperboloid socket contact, may extend through the bed 108 and may be coupled to another contact, wire, or sub-cable. The target contact 430 may also include a barb 436 configured similarly to the barb 406.

The target contacts may also include a target contact 440 having a contact surface 441 and a spring probe 442 extending from a termination end 444. Force may be applied to the spring probe 442 towards the bed 108 such that the spring probe 422 contacts a contact surface 445 of another target contact 443, creating an electrical connection. As with the hyperboloid socket contact 433, the target contact 443 may extend through the bed 108 and be coupled to a wire or sub-cable at a termination end.

The target contact 440 may also include a barb 446 that functions similarly to the barb 406. However, the barb 446 may begin at the contact surface 441 and taper towards the termination end 444. Because the barb 446 is positioned adjacent the contact surface 441, it may further reduce the likelihood of liquids flowing into the outer casing 206 of the receptacle.

The target contacts may also include a target contact 450 having a contact surface 451 and crimping cavity 452 at a termination end 454. A tip 453 of a wire or sub-cable 455 may be positioned within the crimping cavity 452 and the termination end 454 may be crimped, coupling the tip 453 of the wire or sub-cable 455 to the target contact 450, creating an electrical and mechanical connection. The target contact 450 may include a barb 456 being tapered towards the mating surface 302 of the receptacle 102. Because the target contact 450 will be crimped to a wire, it is easier to insert the target contact 450 into the receptacle 102 from the negative Z direction. Thus, the barb 456 is configured to reduce the likelihood of the target contact 450 becoming removed from the receptacle 102 in the negative Z direction.

The target contacts may also include a target contact 460 having a contact surface 461 and a solder cup 462 at a termination end 464. The solder cup 462 may receive a tip 463 of a wire or sub-cable 465. While the tip 463 is within the solder cup 462, solder may be applied to the solder cup 462, electrically and mechanically coupling the tip 463 to the target contact 460. The target contact 460 may also include a barb 466 configured similarly to the barb 456.

Occasionally, contacts within the receptacle 102 may require service. Target contacts having certain termination styles may require more effort to service than other target contacts. For example, using a target contact similar to the target contact 450 may require a relatively large amount of effort because the receptacle 102 will likely need to be decoupled from the bed 108, the target contact 450 removed from the bottom of the receptacle, the wire or sub-cable 455 is cut, and the wire or sub-cable is re-crimped to the new target contact.

Figure 4B:
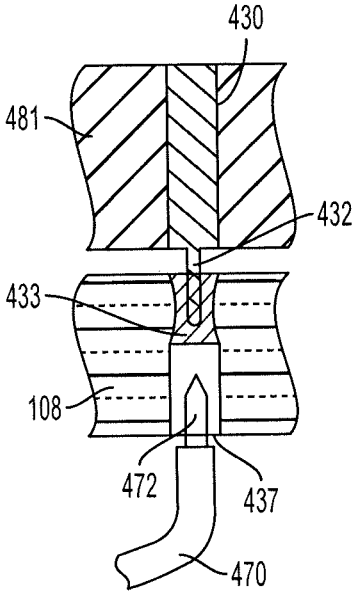
FIG. 4B illustrates a target contact having a PC tail coupled to a wire via a hyperboloid socket contact according to one or more embodiments described herein.

With reference now to FIG. 4B, a receptacle 481 using target contacts similar to the target contact 430 with the PC tail 432 may be relatively easy to replace. The hyperboloid socket contact 433 (or other socket) may be positioned within the bed 108 and may receive the PC tail 432. The hyperboloid socket contact 433 may define a crimp cavity at a termination end 437. The crimp cavity may receive a tip 472 of a wire or sub-cable 470 and the hyperboloid socket contact 433 may be crimped to the wire or sub-cable 470, creating a semi-permanent connection. However, because the PC tail 432 is simply positioned within the hyperboloid socket contact 433, the PC tail 432, and thus the target contact 430, may be easily removed from the hyperboloid socket contact 433. In that regard, the receptacle 481 may be separated from the bed 108 by removing the PC tails from the hyperboloid sockets. Accordingly, the receptacle 481 can be easily replaced in its entirety for servicing and/or the target contact 430 can be easily replaced within the receptacle 481.

Figure 4C:
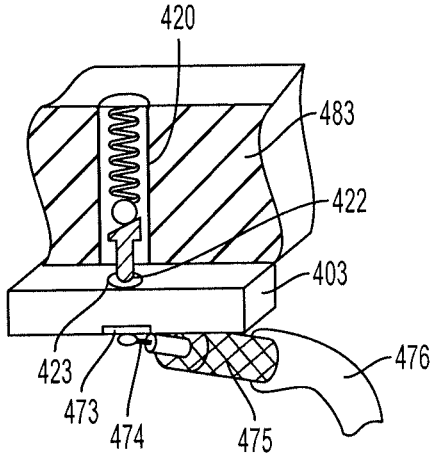
FIG. 4C illustrates a target contact having a spring probe on a termination end that is coupled to a wire via pads of a PCB according to one or more embodiments described herein.

With reference now to FIG. 4C, when a receptacle 483 uses target contacts similar to the target contact 420, replacement may likewise be relatively easy. The spring probe 422 may be in contact with the contact surface 423 of the PCB 403. The contact surface 423 may be in electrical communication with another contact surface 473 of the PCB 403. A sub-cable 476 may include an internal wire 474 and a cable shield 475 separated by a dielectric. The sub-cable 476 may be connected to the contact surface 473 by soldering the internal wire 474 and/or the cable shield 475 to the contact surface 473. Accordingly, the sub-cable 476 may be in electrical communication with the target contact 420. In that regard, the receptacle 483 may be separated from the PCB 403 (and thus the bed) by simply moving the receptacle 483 a sufficient distance from the bed. Accordingly, the entire receptacle may be easily replaced if necessary and/or the target contact 420 can be easily replaced within the receptacle 483.

Figure 4D:
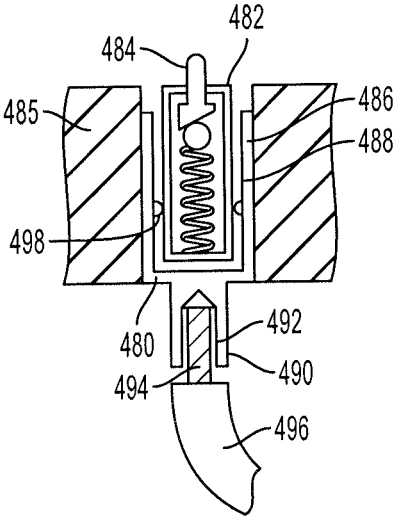
FIG. 4D illustrates a spring probe contact coupled to a wire via a sleeve contact having a spring probe sleeve and a crimp sleeve according to one or more embodiments described herein.

With reference now to FIG. 4D, a sleeve contact 480 and/or spring probe contact 482 may be positioned in a cavity of a receptacle 485 (or a bed), such as in a receptacle casing. The sleeve contact 480 may include a spring probe sleeve 486 defining a cavity 488 and a crimp sleeve 490 defining a cavity 492. The spring probe sleeve 486 may include a detent 498 extending into the cavity 488. In that regard, a spring probe contact 482 may be inserted into the cavity 488 and may contact the sleeve contact 480 via the detent 498, creating an electrical connection. The detent 498 may also assist in retaining the spring probe contact 482 within the sleeve contact 480. A tip 494 of a wire or sub-cable 496 may be positioned within the cavity 492 of the crimp sleeve 490. The crimp sleeve 490 may then be crimped, coupling the sleeve contact 480 to the wire or sub-cable 496.

A plug in use with the sleeve contact of FIG. 4D may include target contacts such that the spring probe contact 482 can contact a target contact of the plug. In that regard, a plurality of sleeve contacts and spring probes may be coupled to a bed and used in place of a receptacle. When the spring probe contact 482 requires replacement, the spring probe contact 482 may be pulled from the sleeve contact 480 and replaced with a new spring probe contact with relatively little effort.

Figure 5:
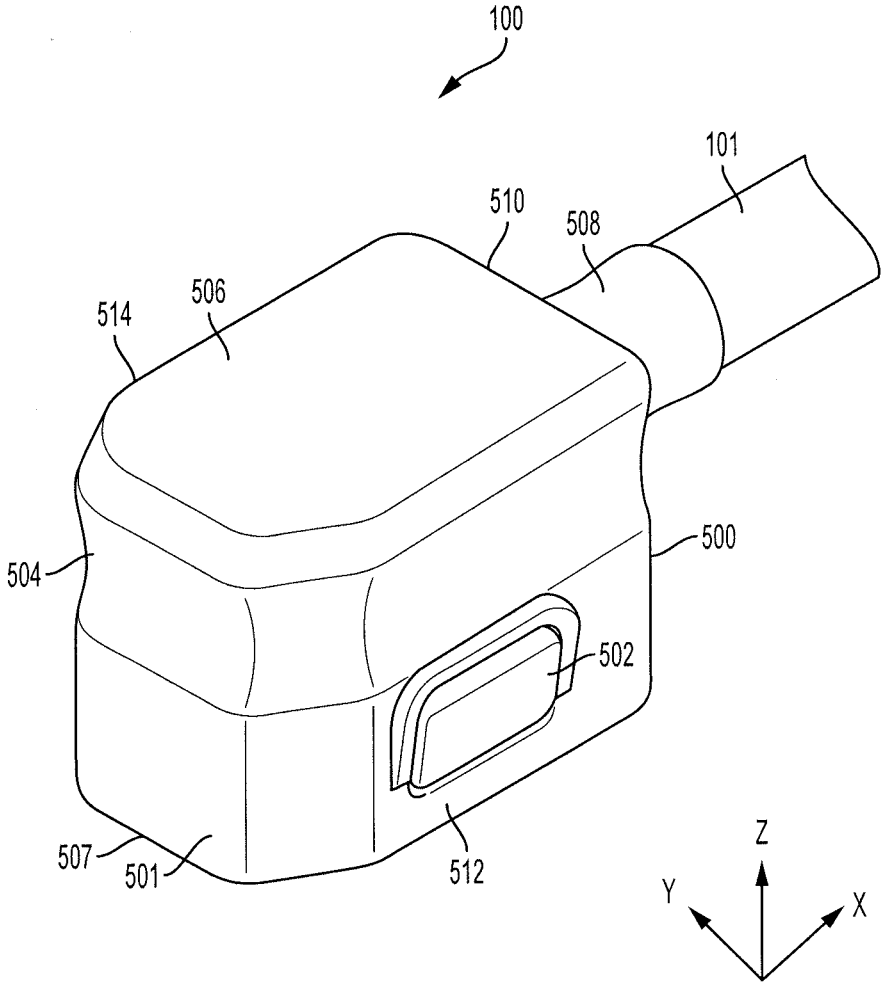
FIG. 5 illustrates the plug of FIG. 1 for connecting to the receptacle of FIG. 1 according to one or more embodiments described herein.

With reference now to FIG. 5, the plug 100 may include a plug casing 500. The plug casing 500 may define a cavity 800 (shown in FIG. 8A) in which components of the plug 100 may be positioned. The plug casing 500 may have a non-mating face 506 and a mating side 507. The cavity 800 defined by the plug casing 500 may be accessible from the mating side 507 of the plug casing 500. Spring probe contacts 631 (shown in FIG. 6) may be positioned within the cavity 800 and extend in the negative Z direction from the mating side 507 or may be recessed within the cavity 800. In that regard and with brief reference to FIGS. 2 and 5, the mating side 507 of the plug casing 500 may be positioned over the mating surface 302 of the receptacle such that a mating end of each of the spring probe contacts 631 is in contact with one of the target contacts 204. In some embodiments, the plug 100 may include 60 spring probe contacts 631 and the receptacle 102 may include 60 target contacts 204. Due to the nature of spring probes, the exact positioning of the spring probe contacts 631 relative to the target contacts 204 is not as important as a connection that requires placement of a pin into a socket, as will be described below with reference to FIG. 7C.

Returning to FIG. 5, the plug casing 500 may also include a hollow cylindrical cable sheath 508 extending from a back end 510 of the plug casing 500. The cable sheath 508 may define a channel (not shown) for receiving the cable 101. In that regard, wires within the cable 101 may be separated from the cable 101 and coupled to termination ends of contacts of the plug 100 within the cavity 800. The cable sheath 508 may prevent unnecessary wear of the cable 101.

The plug 100 may also include one or more release actuators including a release actuator 502 on a first side 512 of the plug casing 500 and a release actuator 609 (shown in FIG. 6) on a second side 514 of the plug casing 500. Additionally or instead, release actuators may be positioned on other sides of the plug casing 500. In various embodiments and with reference to FIGS. 2 and 5, the plug 100 may be removably coupled to the receptacle 102. In that regard, the plug 100 may be removed from the receptacle 102 by exerting a force on the release actuator 502 and the release actuator 609 in a direction away from the receptacle 102 (i.e., the positive Z direction).

Figure 6:
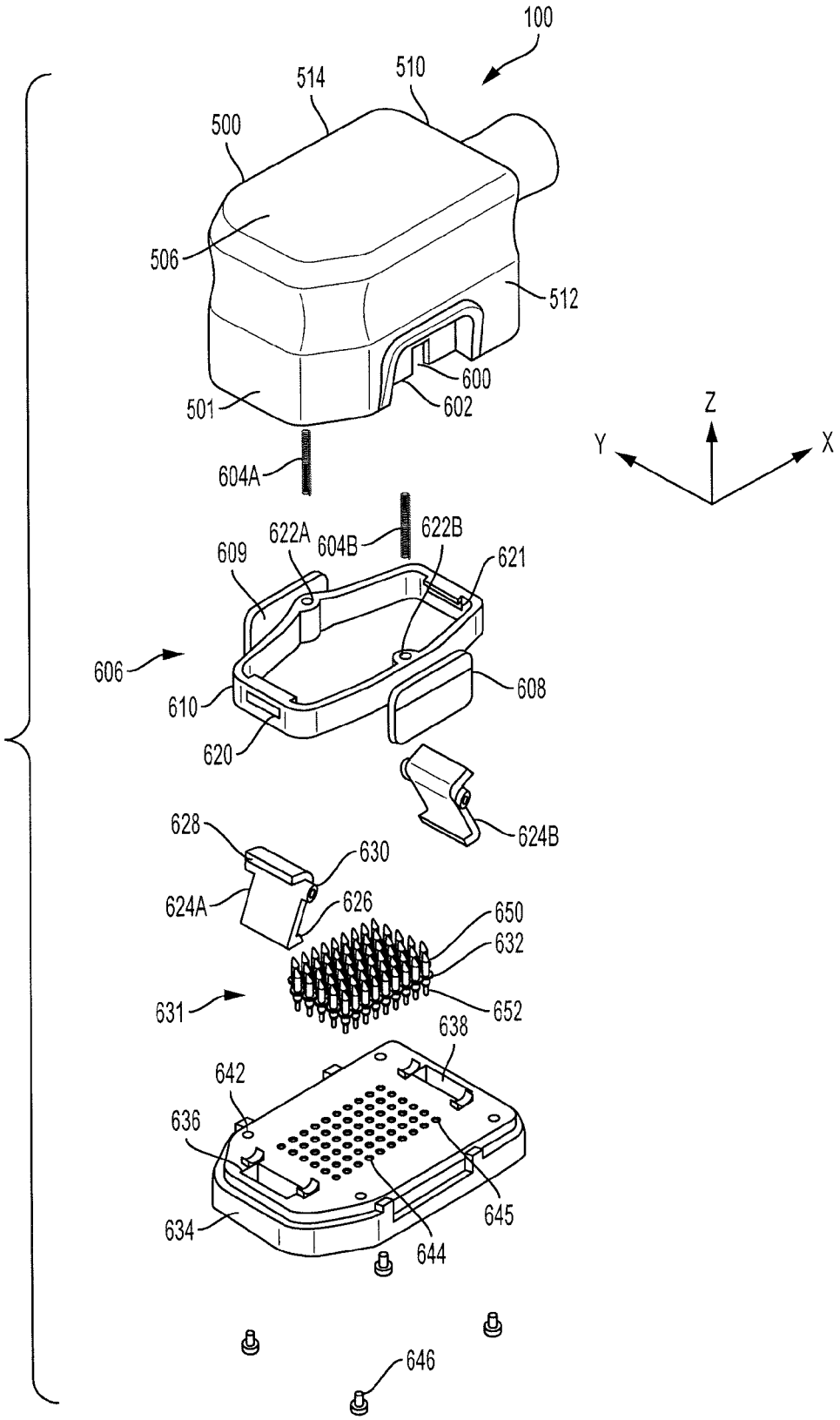
FIG. 6 is an exploded view illustrating components of the plug of FIG. 1 including spring probe contacts according to one or more embodiments described herein.

With reference now to FIG. 6, various components may be coupled to the plug casing 500 and/or positioned within the cavity 800 defined by the plug casing 500. The plug casing 500 may further define an inner slot 600 and a larger outer slot 602 positioned outward from the inner slot 600 on the first side 512. Another inner slot and a larger outer slot may also be similarly defined on the second side 514. A latch actuation collar 606 may include a collar body 610, the release actuator 608 on the first side 512 and the release actuator 609 on the second side 614. Each of the release actuators may be coupled to the collar body 610 via an extension (not shown). The latch actuation collar 606 may be positioned within the cavity 800, and when this happens, the release actuator 608 may be positioned within the larger outer slot 602 and the extension that couples the release actuator 608 to the collar body 610 may extend through the inner slot 600 of the plug casing 500. The inner slot 600 may have a larger distance in the Z direction than the extension. In that regard, the latch actuation collar 606 may move relative to the plug casing 500 along the Z axis.

The collar body 610 may further define spring slots 622 including a spring slot 622A on the second side 514 and a spring slot 622B on the first side 512. The spring slots 622 may be open and receive compression springs 604 from the top (i.e., from the positive Z direction). The spring slot 622A may receive a compression spring 604A and the spring slot 622B may receive a compression spring 604B. The compression springs 604 may extend upwards from the collar body 610 and be compressed when the plug 100 is assembled, such that the compression springs 604 may exert a repulsion force between the plug casing 500 and the latch actuation collar 606. Thus, when the plug 100 is fully assembled, the latch actuation collar 606 may be positioned a maximum distance from the non-mating face 506 of the plug casing 500.

An insulator 634 may be tapered at the forward end 501, allowing it to be received by the plug casing 500 and may define a plurality of probe apertures 644 including a probe aperture 645. The insulator 634, as with the plug casing 500, the latch actuation collar 606, and the latches 624A and 624B, may comprise a material having low conductivity, such as a plastic, thermoplastic, composite, or other material, and each may or may not include the same material. The probe apertures 644 may each receive one of a plurality of spring probe contacts 631, including a spring probe contact 632, each having a spring probe on a mating end and another spring probe or other type of connection on the termination end. The insulator 634 may include a feature, such as detents within the spring probe contacts 631, an interference fit between the insulator 634 and each of the plurality of probe apertures 644, for resisting movement of the plurality of spring probe contacts 631 relative to the insulator 634. Similarly, the spring probe contacts 631 may include barbs or other features for resisting movement relative to the insulator 634.

The spring probe contact 632 may have a mating end 652 and a termination end 650. For example, the probe aperture 645 may receive the spring probe contact 632 such that both ends of the spring probe contact 632 may extend through the probe aperture 645. The mating end 652 may extend from the insulator 634 in the negative Z direction. Stated differently, the mating end 652 may extend outward from a mating face 802 (shown in FIGS. 8A and 8B) of the insulator 634. The termination end 650 may either be recessed within the insulator 634 or extend from the insulator 634 in the positive Z direction. In some embodiments, spring probes could be included with the receptacle 102 and target contacts could be included with the plug 100. Likewise, a receptacle and plug may include contacts having pins and/or hyperboloid sockets, or any such combination of contact technologies.

The insulator 634 may also include a plurality of screw slots 642 spaced apart about the perimeter of the insulator 634. The plug 100 may also include a plurality of screws 646 that may extend through the screw slots 642 and screw into the plug casing 500. In some embodiments, the spring probe contacts 631 may be held in place between the insulator 634 and the plug casing 500 when the insulator 634 is coupled to the plug casing 500.

The collar body 610 may define an actuation slot 620 on the forward end 501 and an actuation slot 621 on the back end 510. The actuation slots may each receive a portion of one or more latches 624. For example, the actuation slot 620 may receive a collar lip 628 of a latch 624A.

The insulator 634 may further define a latch slot 636 on the forward end 501 and a latch slot 638 on the back end 510. The latch 624A may extend through the latch slot 636 and a latch 624B may extend through the latch slot 638. In that regard, a portion of the latch 624A between a receptacle lip 626 and an inner rounded portion 630 may be aligned with the insulator 634 when the latches 624 are in position. In some embodiments, the inner rounded portion 630 may be in contact with a portion of the insulator 634 designed for receiving the inner rounded portion 630.

Figure 7A:
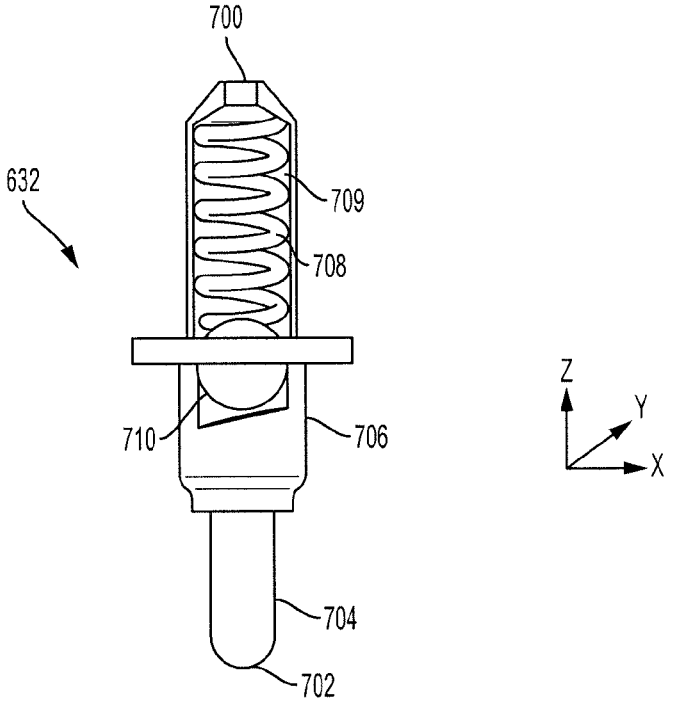
FIG. 7A illustrates one of the spring probes of FIG. 6 according to one or more embodiments described herein.
Figure 7B:
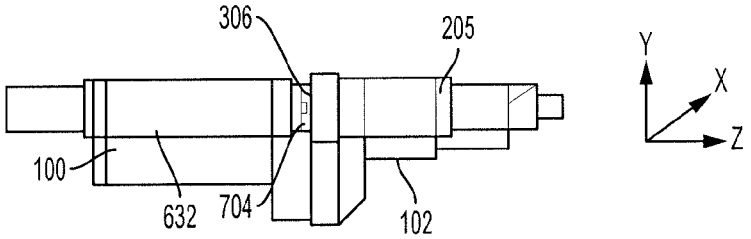
FIG. 7B illustrates a spring probe in electrical connection with a contact surface according to one or more embodiments described herein.

With reference now to FIGS. 7A and 7B, the spring probe contact 632 may include a body 706 and a moveable tip 704. The body 706 may define a cavity 709 in which a spring 708 and a roller 710 are positioned. The moveable tip 704 may be positioned on the mating end 702 of the spring probe contact 632 and may be capable of moving within the cavity 709 relative to the body 706 (i.e., along the Z axis). In that regard, when a force is exerted onto the moveable tip 704 in a direction towards the body 706, the spring 708 is compressed due to movement of the roller 710 and thus exerts a greater force on the moveable tip 704. When the moveable tip 704 is forced against a contact, such as the mating surface 306 of the target contact 205 of the receptacle 102, the compression force of the spring 708 generates a force between the moveable tip 704 and the mating surface 306.

A termination end 700 of the spring probe contact 632 may include a means for coupling the spring probe contact 632 to a wire or other component. In that regard and with reference to FIGS. 5 and 7A, one of the wires of the cable 101 may be coupled to the termination end 700 of the spring probe contact 632 via a crimping cavity, a solder cup, or the like.

Figure 7C:
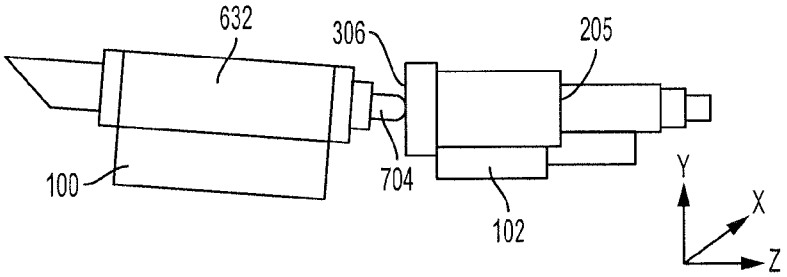
FIG. 7C illustrates the spring probe of FIG. 7B in electrical connection with a contact surface when not directly aligned with the contact surface according to one or more embodiments described herein.

Because the moveable tip 704 is forced towards the mating surface 306, the connection between the moveable tip 704 and the mating surface 306 remains intact in response to vibration or other force that may tend to separate other connectors. With reference to FIG. 7C, the spring probe contact 632 provides additional advantages. Because the moveable tip 704 can move relative to the rest of the spring probe contact 632, it may contact various locations along the mating surface 306. This allows for an electrical connection to be established between the moveable tip 704 and the mating surface 306 even when the spring probe contact 632 is not directly aligned with the target contact 205.

Figure 8B:
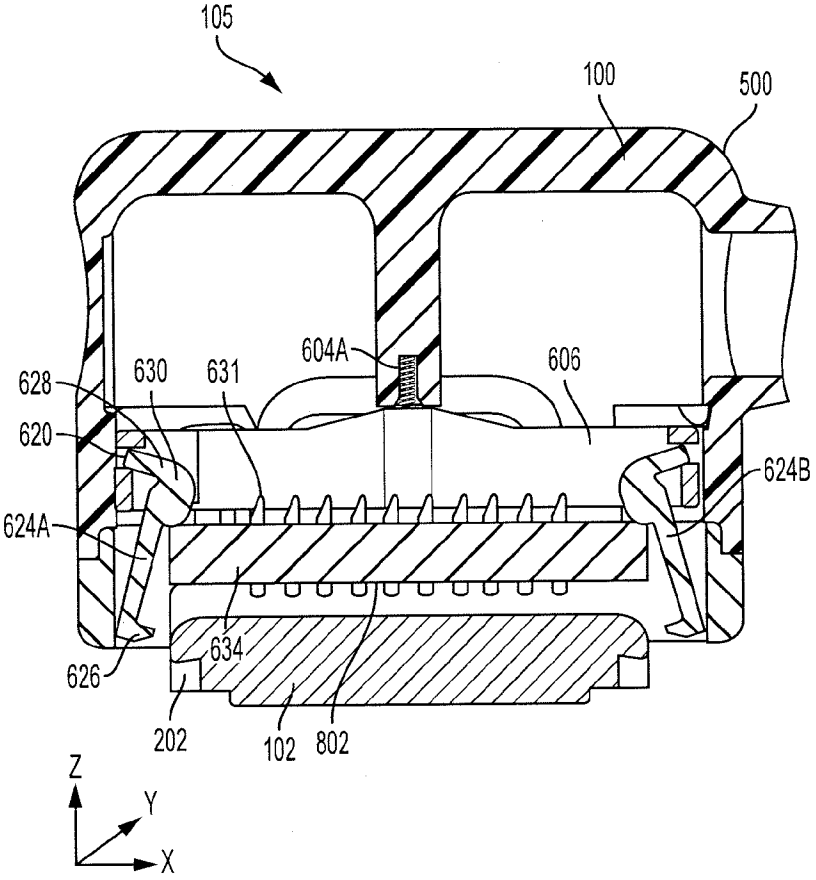
FIG. 8B is a cross-sectional view of the connector of FIG. 1 with the plug being disconnected from the receptacle of FIG. 1 according to one or more embodiments described herein.
Figure 8A:
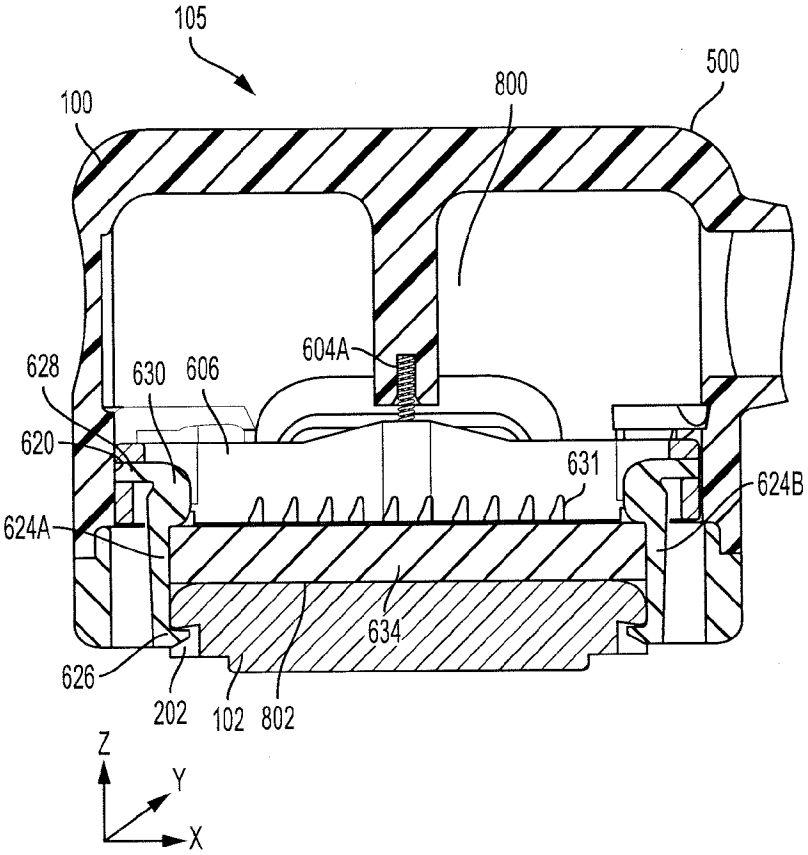
FIG. 8A is a cross-sectional view of the connector of FIG. 1 with the plug being coupled to the receptacle of FIG. 1 according to one or more embodiments described herein.

With reference now to FIGS. 2, 5 and 8A, the latches 624 may be used to couple the plug 100 to the receptacle 102. Initially, the plug 100 may be positioned above the receptacle 102 such that the forward end 210 of the receptacle is aligned with the forward end 501 of the plug 100. The plug 100 may then be pushed in the negative Z direction towards the receptacle 102 until the receptacle 102 is at least partially positioned within the cavity 800. After sufficient downward pressure, the receptacle lips, such as the receptacle lip 626, of the latches 624 will be received by the openings of the receptacle 102, coupling the plug 100 to the receptacle 102. When in this position, the moveable tips of the spring probe contacts 631 may be in contact with the contact surfaces of the target contacts 204.

With renewed reference to FIG. 8A, when the plug 100 is coupled to the receptacle 102, the receptacle lip 626 of the latch 624A may be received by the second receiving slot 202 of the receptacle 102. Similarly, the collar lip 628 may be positioned within the actuation slot 620 of the latch actuation collar 606. When the plug 100 is coupled to the receptacle 102, the compression spring 604A is exerting a force on the latch actuation collar 606 in the negative Z direction towards the receptacle 102. As discussed above, the inner rounded portion 630 of the latch 624A may contact the insulator 634 and is free to rotate relative to the insulator 634. However, due to the downward force of the compression spring 604A, the latch actuation collar 606 prevents rotation of the latch 624A relative to the receptacle 102.

With reference now to FIGS. 6, 8A and 8B, the release actuator 608 and the release actuator 609 may be used to detach the plug 100 from the receptacle 102. As mentioned above, when the plug 100 is coupled to the receptacle 102, the force of the compression spring 604A prevents rotation of the latch 624A relative to the insulator 634, causing the receptacle lips to remain in the receiving slots of the receptacle 102. However, when a user exerts a force on the release actuator 608 and/or the release actuator 609 in the positive Z direction, the latch actuation collar 606 may be moved in the positive Z direction relative to the insulator 634. In some embodiments, the plug 100 may be designed such that movement of the release actuator 608 and/or the release actuator 609 in another direction results in movement of the latch actuation collar 606 in the positive Z direction.

Because the collar lip 628 is received by the actuation slot 620, this movement of the latch actuation collar 606 relative to the insulator 634 causes the inner rounded portion 630 to rotate clockwise relative to the insulator 634. This clockwise rotation of the latch 624A causes the receptacle lip 626 to separate from the second receiving slot 202. The latch 624B may rotate counterclockwise relative to the insulator 634 and release in a similar manner. Removal of the receptacle lips from the receiving slots of the receptacle 102 allows the plug 100 to move relative to, and thus detach from, the receptacle 102.

When the plug 100 is released from the receptacle 102, the force exerted on the release actuator 608 and the release actuator 609, as well as any other force applied to the plug 100 in the positive Z direction, may cause the plug 100 to move upward relative to the receptacle 102. Additionally and with reference to FIGS. 6, 7A and 8B, the spring probe contacts 631 may also provide a force for separating the plug 100 and the receptacle 102. Each of the spring probe contacts 631 include a spring similar to the spring 708 of the spring probe contact 632. Although the force exerted by the spring 708 may be relatively small, the plug 100 may include a number of spring probe contacts 631. Accordingly, a total sum of the force exerted by the springs of the spring probe contacts 631 may be relatively large. Thus, the plurality of spring probe contacts 631 may exert a negative unmating force between the plug 100 and the receptacle 102. This negative unmating force may reduce the likelihood of an injury caused by repeated use of the plug 100, as the force required by the user for each separation is relatively small.

Figure 9:
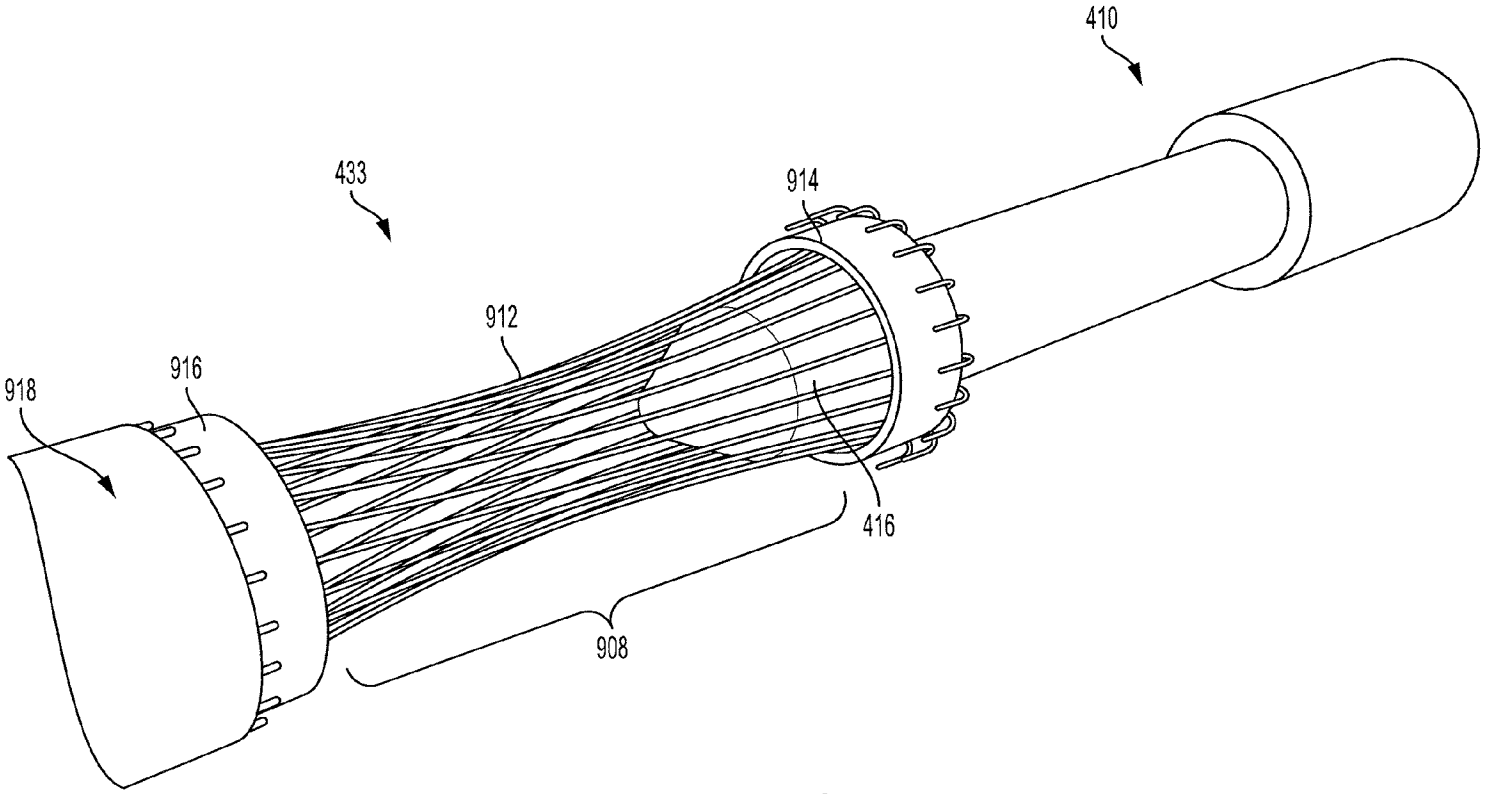
FIG. 9 illustrates a view of a hyperboloid socket contact, with an outer barrel removed for clarity, for receiving a pin tip according to one or more embodiments described herein.

With reference now to FIGS. 4A and 9, the bed 108 may include a receptacle connector for connecting the receptacle 102 to the cable 110. For example, the receptacle connector may include one or more contacts, such as the hyperboloid socket contact 433 or the target contact 443. In some embodiments, the bed 108 may include or be coupled to a PCB, such as the PCB 403. In some embodiments, the bed 108 may define a plurality of cavities or through holes such that wires, cables, or sub-cables may extend through the bed 908.

The hyperboloid socket contact 433 may include a first collar 914 and a second collar 916, each resembling a cylinder. The hyperboloid socket contact 433 may include a plurality of wires 912 each coupled to and extending between the first collar 914 and the second collar 916. The plurality of wires 912 may resemble a hyperboloid, such that a diameter of the hyperboloid socket of the hyperboloid socket contact 433 is at a minimum between the first collar 914 and the second collar 916 and increases towards the first collar 914 and the second collar 916. In that regard, when the hyperboloid socket receives the termination end 424 of the target contact 410, the PC tail 432 of the termination end 424 may force the wires 912 outward, such that a force is exerted from each of the wires 912 onto the termination end 424. An outer barrel (not shown) may surround the first collar 914, the second collar 916, and the plurality of wires 912. The hyperboloid socket contact 433 may also include a termination end 918 for connecting with any style of contact.

Figure 10:
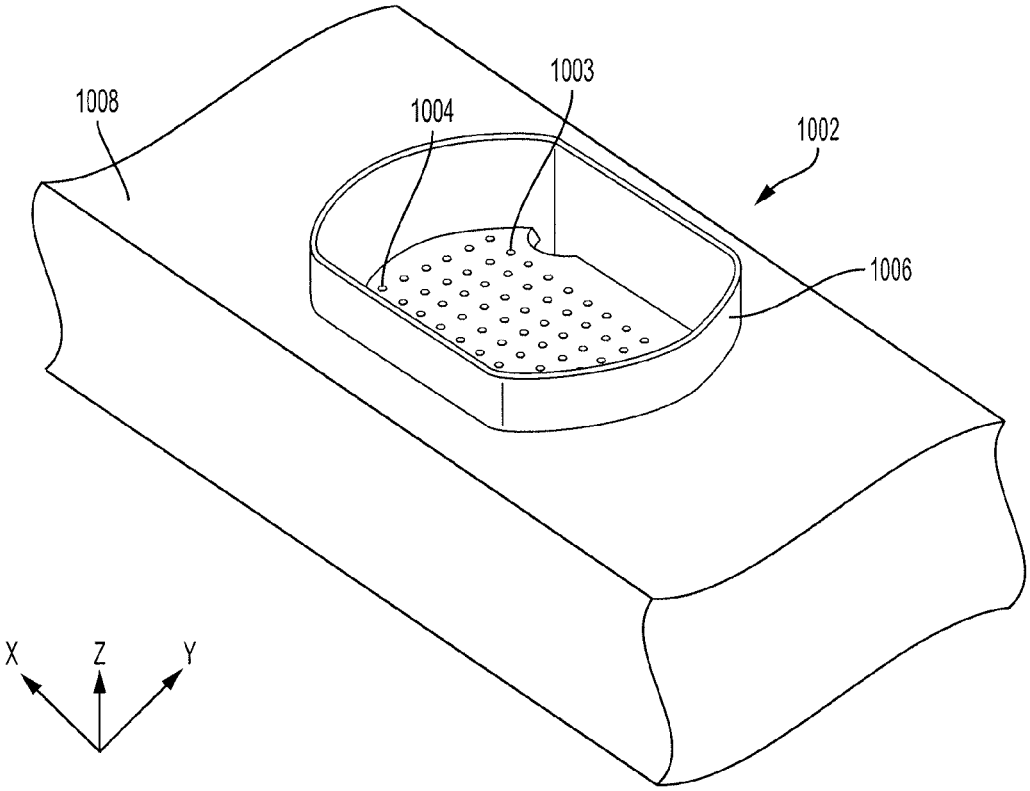
FIG. 10 illustrates a receptacle of another connector coupled to a bed according to one or more embodiments described herein.
Figure 15:
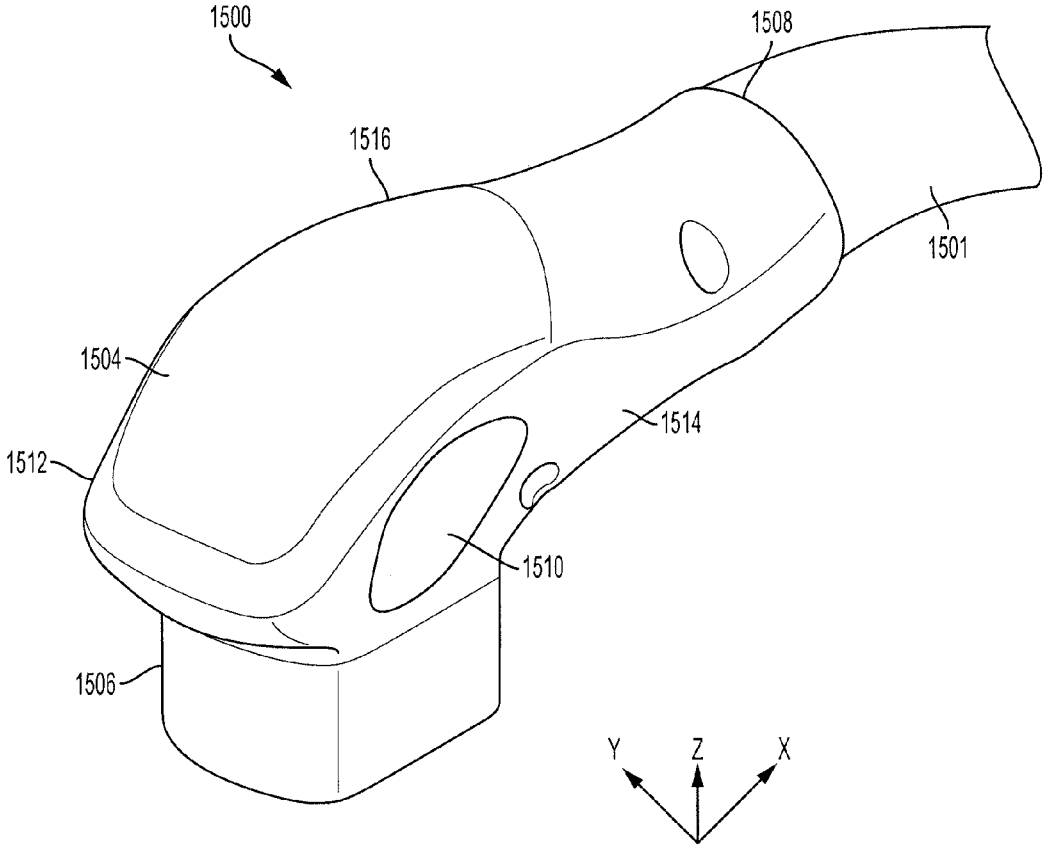
FIG. 15 illustrates a plug for connecting to the receptacle of FIG. 10 according to one or more embodiments described herein.

With reference now to FIGS. 1, 10 and 15, a receptacle 1002 may be used instead of the receptacle 102 and a plug 1500 may be used instead of the plug 100. As with the receptacle 102, the receptacle 1002 may be coupled to a bed 1008 and the plug 1500 may be coupled to a cable connected to a coil. Additionally, the receptacle 1002 and the plug 1500 may together be considered a connector and may be used in systems other than imaging systems.

With reference directed now to FIG. 10, the receptacle 1002 may have a body 1006 and a plurality of hyperboloid socket contacts 1003 including a hyperboloid socket contact 1004. As described above, the receptacle 1002 may be coupled to a bed 1008.

Figure 11:
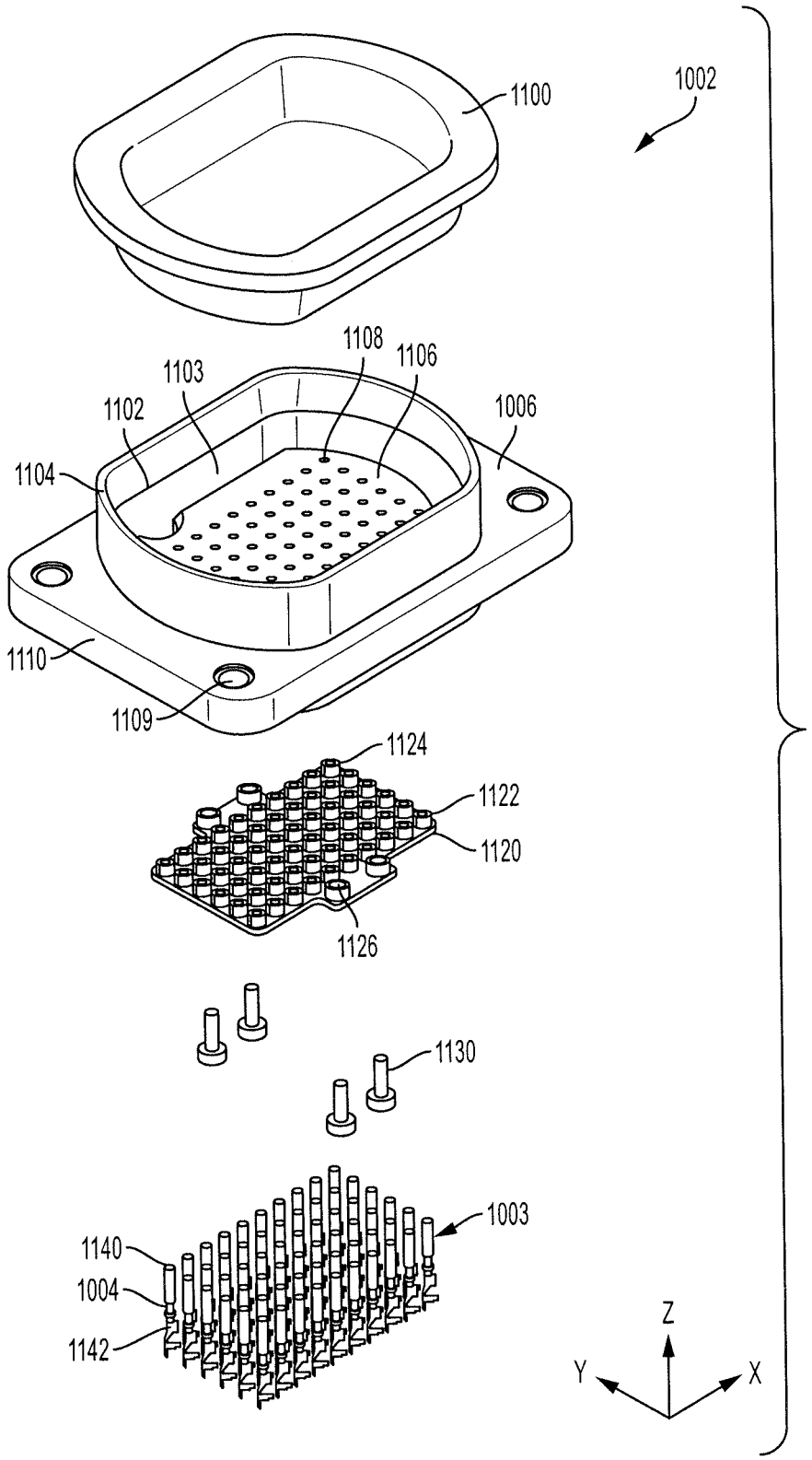
FIG. 11 is an exploded view of the receptacle of FIG. 10 illustrating various components of the receptacle including stamped hyperboloid socket contacts according to one or more embodiments described herein.

With reference now to FIG. 11, the body 1006 may include an outer shell 1104 that resembles a rounded rectangular tube and defining a volume 1102. A mating surface 1106 may be positioned within the volume 1102 and may be separated from the outer shell 1104 by a gap 1103. With brief reference to FIGS. 11 and 15, a plug 1500 may include a mating end 1506. The mating end 1506 may be designed to fit within the outer shell 1104. The mating end 1506 may define a cavity such that the mating end 1506 can be positioned in the gap 1103 and the mating surface 1106 can extend into the cavity defined by the mating end 1506.

With renewed reference to FIG. 11, the body 1006 may also include a mounting member 1110 coupled to and extending outward from the perimeter of the outer shell 1104 along a plane parallel to the X-Y plane. The mounting member 1110 may include a plurality of screw holes 1109 that may or may not include threading. With brief reference to FIGS. 10 and 11, the body 1006 may be coupled to the bed 1008 using screws extending through the bed 1008 into the screw holes 1109 of the mounting member 1110. In some embodiments, the bed 1008 may include a hole such that the mounting member 1110 can be positioned adjacent a bottom surface of the bed 1008 and the outer shell 1104 extends through the bed 1008 and away from the bed 1008 in the positive Z direction. In some embodiments, the mounting member 1110 can be positioned adjacent a top surface of the bed 1008 and the outer shell 1104 may or may not extend into the bed 1008.

In some embodiments, the receptacle 1002 may be configured to receive pin tips. In that regard, the mating surface 1106 may define a plurality of apertures 1108 having a sufficient diameter such that a pin or pin tip may extend through the plurality of apertures 1108.

A contact retention plate 1120 may include a plurality of contact retention features 1122, including a contact retention feature 1124, for receiving a plurality of hyperboloid socket contacts 1003, including a hyperboloid socket contact 1004. The contact retention plate 1120, as with the body 1006 and the protective cap 1100, may comprise a material having a low conductivity, such as a plastic or other insulating material, and each may or may not include the same material. The hyperboloid socket contact 1004 may have a mating end 1140 defining an opening to the hyperboloid socket of the hyperboloid socket contact 1004 and a termination end 1142. The mating end 1140 may be inserted through the contact retention plate 1120 such that each of the hyperboloid socket contacts 1003 is received by one of the contact retention features 1122. As described below, the contact retention features 1122 may include a feature that reduces the likelihood of each of the hyperboloid socket contacts 1003 moving relative to the contact retention features 1122. When the contact retention plate 1120 is coupled to the body 1006, each of the hyperboloid socket contacts 1003 may be coupled to the body 1006 and aligned with one of the apertures 1108. Other methods of coupling the plurality of hyperboloid socket contacts 1003 to the body 1006 may be used without departing from the scope of the disclosure. Additionally, socket contacts other than hyperboloid socket contacts, such as bifurcated socket contacts, may be used without departing from the scope of the disclosure.

The contact retention plate 1120 may also define a plurality of screw holes 1126 configured to receive a plurality of screws 1130. In that regard, the screws 1130 may be inserted through the screw holes 1126 and into the body 1006, coupling the contact retention plate 1120 to the body 1006.

It may be desirable to prevent liquids from reaching the plurality of hyperboloid socket contacts 1003. In that regard, the receptacle 1002 may also include a protective cap 1100. The protective cap 1100 may be designed such that it can be received by the volume 1102 and remain in contact with the outer shell 1104, forming a seal with the outer shell 1104 and reducing the likelihood of liquid entering the volume 1102 and reaching one or more of the plurality of hyperboloid socket contacts 1003.

Figure 12A:
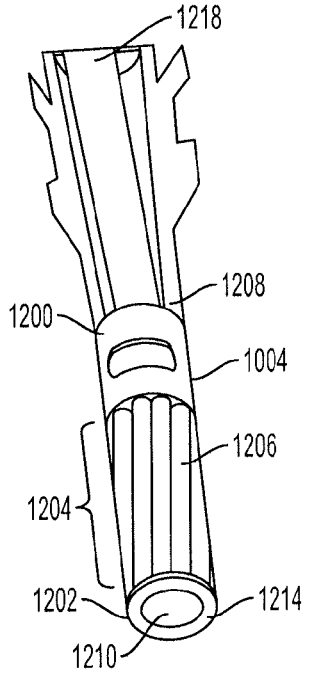
FIG. 12A is a view of one of the stamped hyperboloid socket contacts of FIG. 11 with an outer barrel removed for clarity according to one or more embodiments described herein.
Figure 12B:
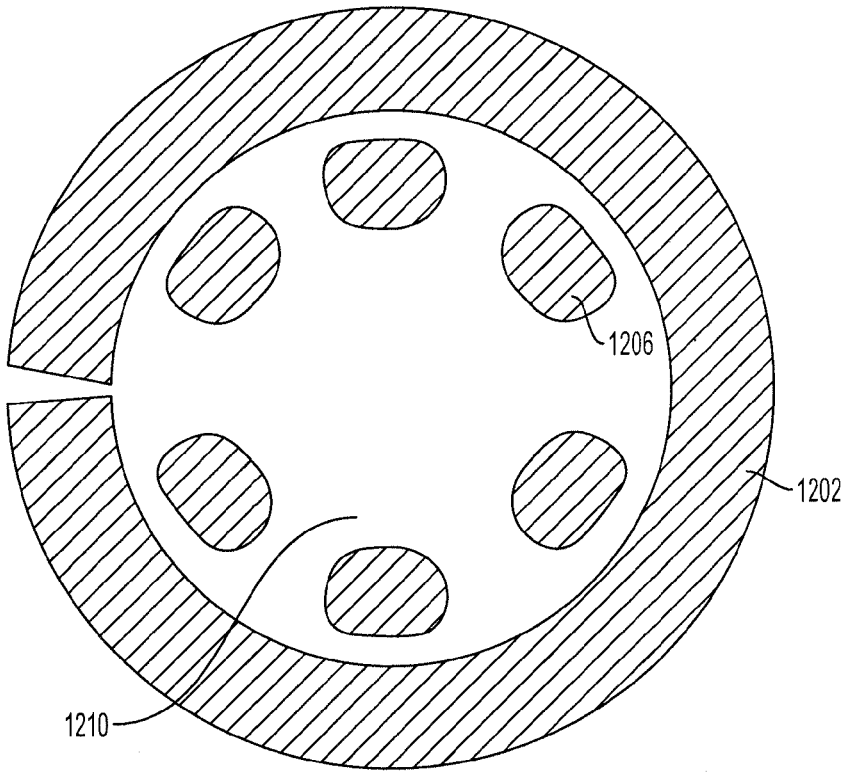
FIG. 12B is a cross-sectional view of the stamped hyperboloid socket contact of FIG. 12A according to one or more embodiments described herein.

In some embodiments, the plurality of hyperboloid socket contacts 1003 may be formed using a stamping method, however, non-stamped hyperboloid contacts are also contemplated. For example and with reference to FIGS. 12A and 12B, the hyperboloid socket contact 1004 may be stamped from sheet metal and formed into the desired shape. The hyperboloid socket contact 1004 may include a formed first annular portion 1200 and a formed second annular portion 1202 on either end of a contact portion 1204. A plurality of inner contacts 1206 may extend between the first annular portion 1200 and the second annular portion 1202. A diameter of the hyperboloid socket contact 1004 may be smallest near a center of the contact portion 1204 and increase towards the first annular portion 1200 and the second annular portion 1202. An outer barrel (not shown) may surround the first annular portion 1200, the second annular portion 1202, and the contact portion 1204. The hyperboloid socket contact 1004 may also have a termination end 1216 and define an opening 1210 at a mating end. The hyperboloid socket contact 1004 can receive a pin tip via the opening 1210. As the pin extends through the hyperboloid socket contact 1004, the inner contacts 1206 may be forced outward, such that they apply pressure to the received pin tip. The termination end 1216 may be adapted to connect to a wire, a PC board, or another contact in the same manner as any of the termination ends 308 shown in FIG. 4A.

Figure 13:
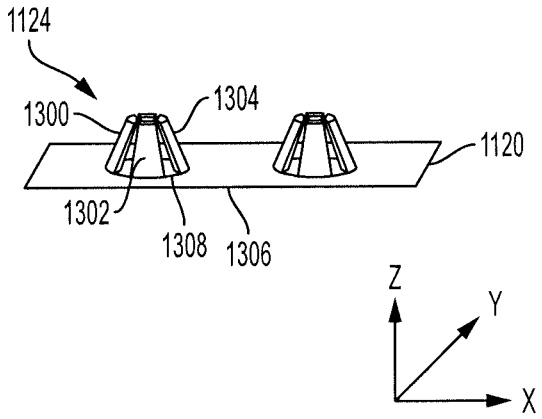
FIG. 13 illustrates a contact retention feature of a contact retention plate of the receptacle of FIG. 10 according to one or more embodiments described herein.

The hyperboloid socket contact 1004 may also include a neck 1208 having a smaller diameter than the first annular portion 1200, the second annular portion 1202, and/or the contact portion 1204. In that regard and with reference to FIGS. 12A and 13, the contact retention feature 1124 may be designed to hold the hyperboloid socket contact 1004 in place relative to the contact retention plate 1120. The contact retention feature 1124 may include a plurality of arms including a first arm 1300, a second arm 1302 and a third arm 1304, that extend away from the contact retention plate 1120 in the positive Z direction and begin to converge as they extend from the contact retention plate 1120. The arms 1300, 1302 and 1304 surround an opening 1308 defined by the contact retention plate 1120 through which the hyperboloid socket contact 1004 is received. As the hyperboloid socket contact 1004 is inserted into the opening 1308 from a bottom 1306 of the contact retention plate 1120, the hyperboloid socket contact 1004 causes the fingers to separate. The hyperboloid socket contact 1004 may be inserted such that the second annular portion 1202 extends through the contact retention feature 1124 first. As the neck 1208 is extended past the fingers, each of the fingers is allowed to again converge due to the smaller diameter of the neck 1208. Thus, when the hyperboloid socket contact 1004 is received by the contact retention feature 1124, the convergence of the fingers around the neck 1208 reduces the tendency of the hyperboloid socket contact 1004 to separate from the contact retention feature 1124.

Figure 14A:
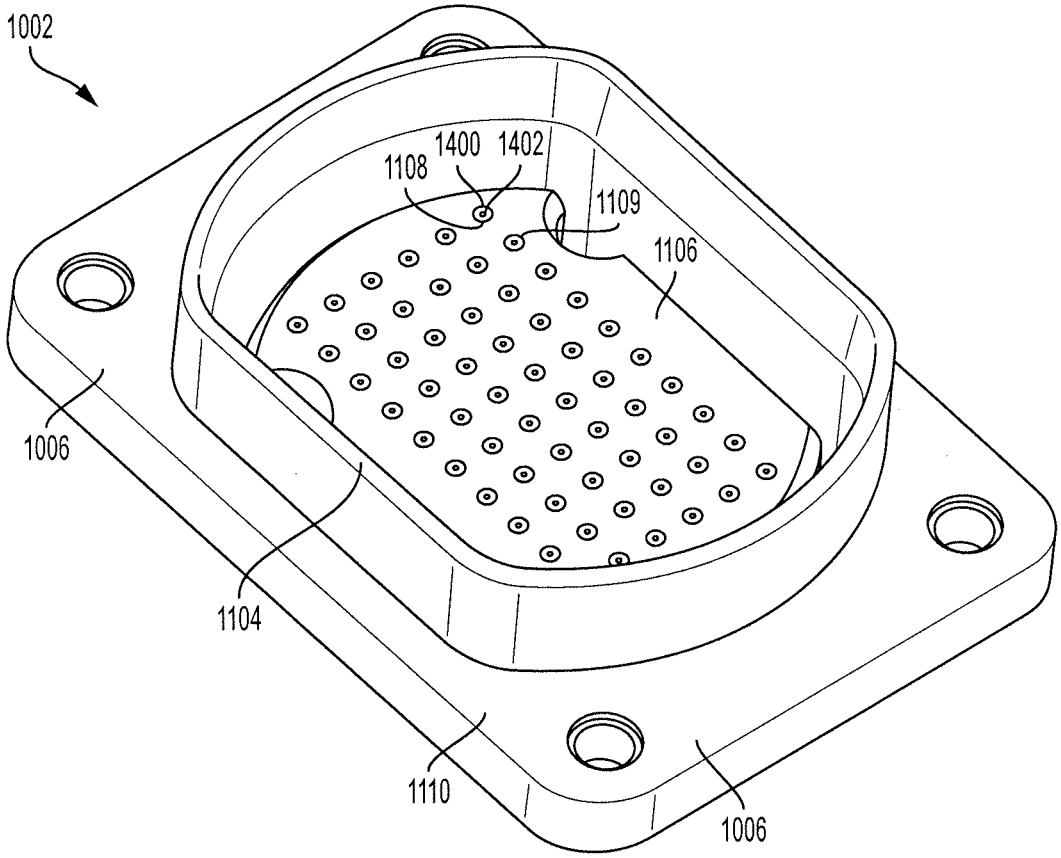
FIG. 14A illustrates a receptacle defining apertures and including elastic material within the apertures that define openings according to one or more embodiments described herein.
Figure 14B:
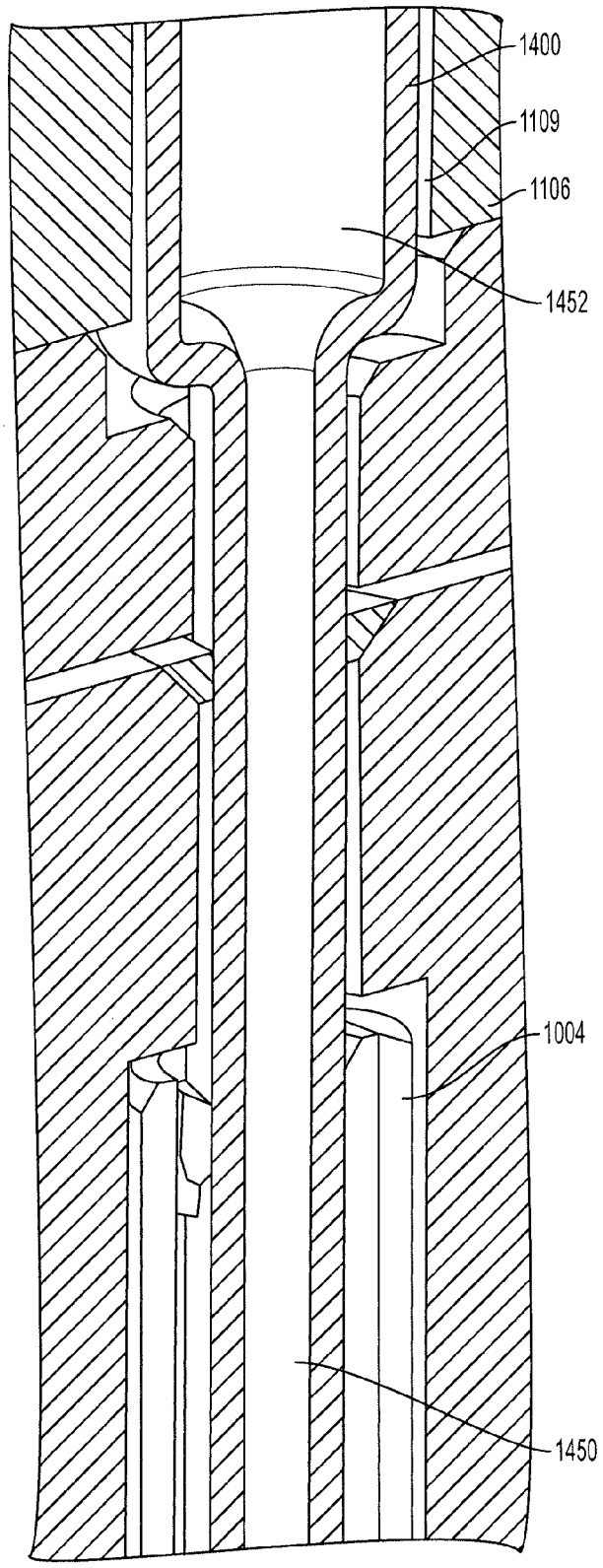
FIG. 14B is a cross-sectional view of a portion of the receptacle of FIG. 14A illustrating a contact having a pin tip positioned in one of the openings of the elastic material according to one or more embodiments described herein.

With reference now to FIGS. 14A and 14B, in some embodiments, the receptacle 1002 may include an elastic material 1400 positioned within each of the plurality of apertures 1108 and defining an opening 1402. The elastic material 1400 may include silicon, rubber, and/or other elastic material capable of being deformed under force and returning to its formed state after the force is removed. When in a natural (i.e., uncompressed) state, the opening 1402 may be sufficiently small that most liquids or debris cannot pass through the opening 1402. Thus, when liquid is present on the mating surface 1106, the liquid may not flow through the apertures 1108. This allows for easy cleaning of the receptacle 1002 as the mating surface can simply be wiped down to remove liquids and debris. This may also eliminate the need for a protective door.

However, the opening 1402 may be sufficiently large to receive a pin tip 1450 of a pin contact 1452. As the pin tip 1450 is inserted through the opening 1402 at the mating end, it may deform the elastic material 1400 and, thus, enlarge the opening 1402. Due to the elasticity of the elastic material 1400, the pin tip 1450 may extend through the opening 1402 and be received by the hyperboloid socket contact 1004. When the pin tip 1450 is removed, the elastic material 1400 returns to a relaxed state such that the diameter of the opening 1402 is again sufficiently small to reduce the likelihood of liquids reaching the hyperboloid socket contact 1004.

With reference now to FIG. 15, the plug 1500 may include an outer casing 1504. The outer casing 1504 may include a grip area 1510 on a first side 1514 and a grip area 1512 on a second side 1516. The grip area 1510 and the grip area 1512 enable easy handling of the plug 1500. In that regard, the plug 1500 may be gripped in various ergonomic manners, reducing the likelihood of injury from repeated use of the plug 1500.

The outer casing 1504 may define a cavity 1601 (illustrated in FIG. 16) therein between a mating end 1506 and a cable sheath portion 1508. A plurality of pin contacts may be coupled to the outer casing 1504 and have a pin tip proximate the mating end 1506 of the outer casing 1504 such that the pin tips may be connected to the hyperboloid socket contacts 1003 of the receptacle 1002 of FIG. 10 when the mating end 1506 is received by the receptacle 1002.

The cable sheath portion 1508 may have a tubular shape designed to receive a cable 1501. The cable 1501 may include a plurality of wires and/or sub-cables such that each of the wires/sub-cables may extend into the cavity 1601 and contact a termination end of one or more of the contacts. The cable sheath portion 1508 may reduce the likelihood of damage to the cable 1501.

Figure 16:
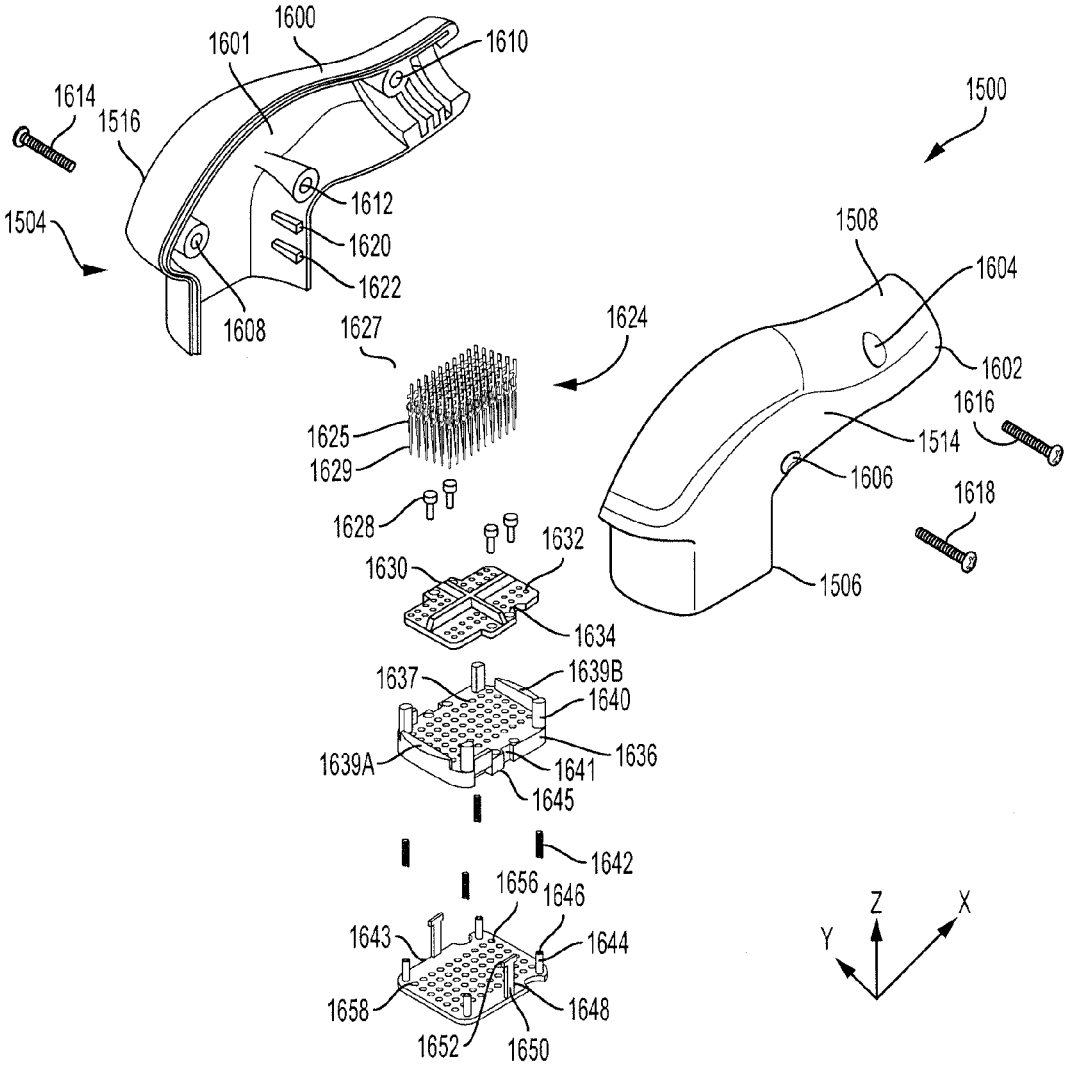
FIG. 16 is an exploded view of the plug of FIG. 15 illustrating various components including a contact having a pin tip according to one or more embodiments described herein.

With reference now to FIG. 16, the outer casing 1504 may include a first shell 1600 and a second shell 1602. The second shell 1602 may define a first screw slot 1604 and a second screw slot 1606. The first shell 1600 may define a screw slot 1608, a first threaded slot 1610, and a second threaded slot 1612. A first screw 1614 may extend through the screw slot 1608 into a threaded slot of the second shell 1602. Similarly, a screw 1616 and a screw 1618 may extend through the first screw slot 1604 and the second screw slot 1606, respectively, and to the first threaded slot 1610 and the second threaded slot 1612, respectively. In that regard, the first shell 1600 and the second shell 1602 may be coupled together via the screws such that the cavity 1601 is defined between the first shell 1600 and the second shell 1602.

A plurality of contacts 1624 having pin tips on a mating end 1629, similar to the pin contact 1452, may be positioned within the cavity 1601. As with the hyperboloid socket contact 1004 of FIG. 12A, the contacts 1624 may be stamped and formed from sheet metal. A contact 1625 may include a termination end 1627 and the mating end 1629. The termination end 1627 may be designed to be coupled to a wire of a cable extending through the cable sheath portion 1508. The mating end 1629 may resemble a pin tip and may be received by a hyperboloid socket, such as the hyperboloid socket contact 1004 of FIG. 11.

In various embodiments, the plug 1500 may include 60 contacts 1624 and the receptacle of FIG. 11 may include 60 hyperboloid sockets.

The plug 1500 may further include a contact retention plate 1630. The contact retention plate 1630 may define and/or include a plurality of pin receivers 1632. Each of the pin receivers 1632 may one of the contacts 1624 and retain the contact in a similar manner as the contact retention features 1122 grasp the hyperboloid socket contacts 1003 of FIG. 11. Accordingly, the contact retention plate 1630 resists movement of the contacts 1624 relative to the contact retention plate 1630 and, as described below, to the outer casing 1504. Other methods of coupling the plurality of contacts 1624 to the outer casing 1504 may be used without departing from the scope of the disclosure.

The plug 1500 may further include an insulator 1636 defining a plurality of apertures 1637 through which the contacts 1624 may extend. The insulator 1636 may further define two coupling holes 1645 that align with screw apertures 1634 of the contact retention plate 1630. A plurality of screws 1628 may extend through the screw apertures 1634 of the contact retention plate 1630 and be received by the two coupling holes 1645 of the insulator 1636, coupling the contact retention plate 1630 to the insulator 1636. In that regard, the contacts 1624 may be coupled to, and resist movement relative to, the insulator.

The outer casing 1504 may have an inner surface defining a first shelf 1620 and a second shelf 1622, each extending inward from the inner surface of the outer casing 1504. The insulator 1636 may include a first guide 1639A and a second guide 1639B that each may be received between shelves of the outer casing 1504. For example, the second guide 1639B may be received by a gap between the first shelf 1620 and the second shelf 1622. Due to similar dimensions of the insulator 1636 and the inner surface of the outer casing 1504 in the X and Y directions, when the guides 1639 are received by the gap between the shelves of the outer casing 1504 and the first shell 1600 is coupled to the second shell 1602, the insulator 1636 (and thus the contact retention plate 1630 and the contacts 1624) may be coupled to and resist movement relative to the outer casing 1504.

The insulator 1636 may further include a plurality of posts 1640 extending in the positive Z direction from the insulator 1636. The posts 1640 may define an area therebetween in which the contact retention plate 1630 and the bases of the contacts 1624 may be positioned.

The plug 1500 may further include a pin protection plate 1643. The pin protection plate 1643, as with the outer casing 1504, the contact retention plate 1630, and the insulator 1636, may comprise a material having low conductivity such as a plastic or other insulating material and each may or may not include the same material. The pin protection plate 1643 may define and/or include a plurality of pin guides 1656, including a pin guide 1658. A portion of each of the contacts 1624 may extend through one of the pin guides 1656.

The pin protection plate 1643 may further include a plurality of posts 1644 each defining a spring hole 1646. One of a plurality of compression springs 1642 may be received by each of the spring holes 1646 and extend in the positive Z direction from the posts 1644. The compression springs 1642 may contact the insulator 1636 and apply pressure thereto, applying a repulsion force between the pin protection plate 1643 and the insulator 1636 when in a resting state. In various embodiments, another feature may retain the compression springs 1642 in place relative to the insulator 1636 and the pin protection plate 1643.

The pin protection plate 1643 may further include two T-bars 1648, each positioned on one of the first side 1514 or the second side 1516. The two T-bars 1648 may each include an elongate portion 1650 and a cross portion 1652 positioned at the farthest end of the elongate portion 1650 in the positive Z direction from the pin protection plate 1643. The elongate portion 1650 may be inserted into connector slots 1641 defined by the insulator 1636 such that the T-bars 1648 allow movement of the pin protection plate 1643 relative to the insulator 1636. A distance of the cross portion 1652 in the X direction may be larger than a distance of the connector slots 1641 in the X direction, thus reducing the likelihood of separation of the pin protection plate 1643 from the insulator 1636 beyond a predetermined distance. When the plug 1500 is not coupled to a receptacle, the compression springs 1642 cause the pin protection plate 1643 to be separated from the insulator 1636 by the predetermined distance.

Figure 17A:
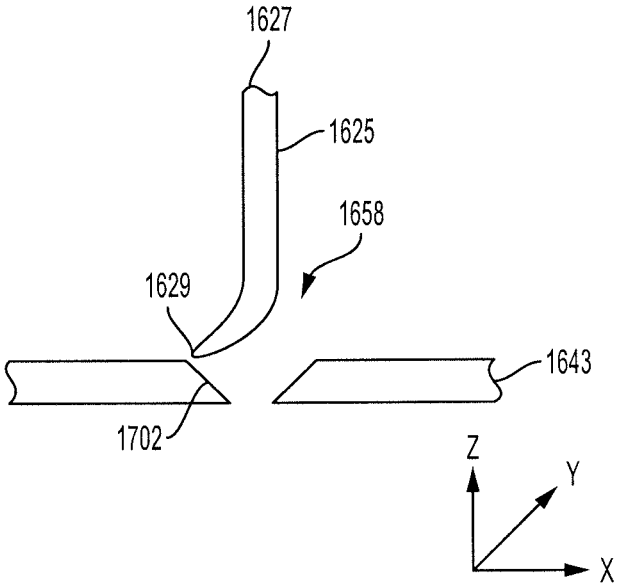
FIG. 17A is a cross-sectional view of a bent contact pin tip of FIG. 16 prior to being moved through a funnel defined by a pin protection plate of the plug of FIG. 15 according to one or more embodiments described herein.
Figure 17B:
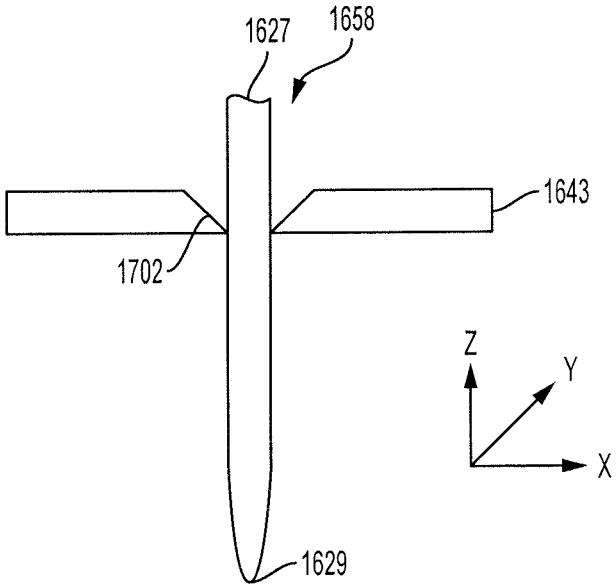
FIG. 17B is a cross-sectional view of the contact pin tip of FIG. 17A having the bend removed after being moved through the funnel according to one or more embodiments described herein.

In some embodiments and with reference to FIGS. 17A and 17B, the pin guide 1658 may define a funnel 1702 tapering towards the negative Z direction. The funnel 1702 may resemble an inverted cone. As the contact 1625 is extended through the pin guide 1658, the shape of the funnel 1702 may remove any unwanted curvature of the contact 1625. This increases the life of the plug 1500 of FIG. 15, as the contact 1625 may remain in proper operating condition for a longer period of time.

Figure 18B:
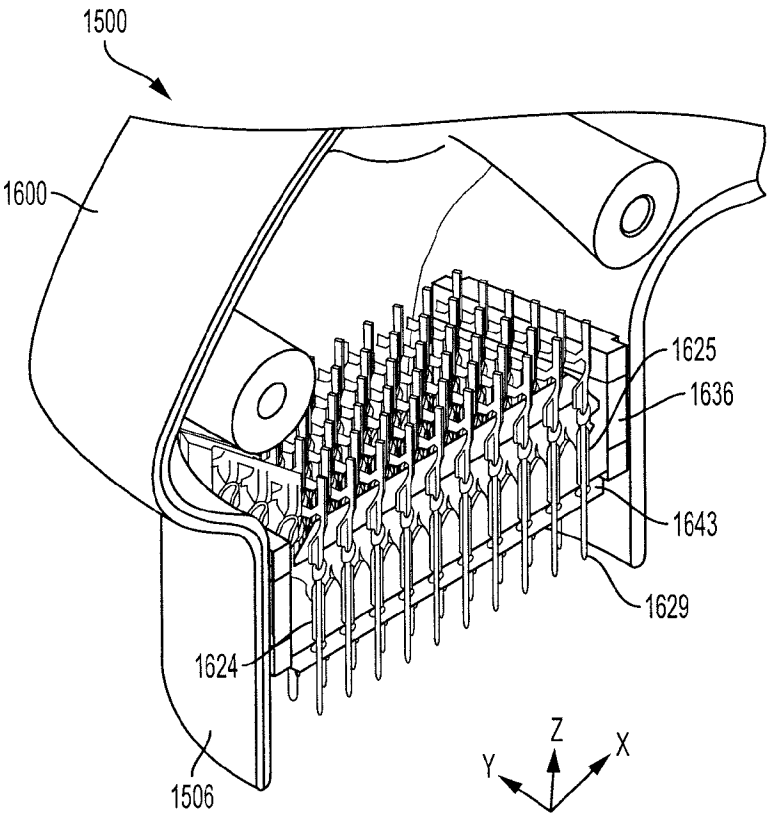
FIG. 18B is a cross-sectional view of the plug of FIG. 15 illustrating the pin protection plate of FIG. 17A in a connected position according to one or more embodiments described herein.
Figure 18A:
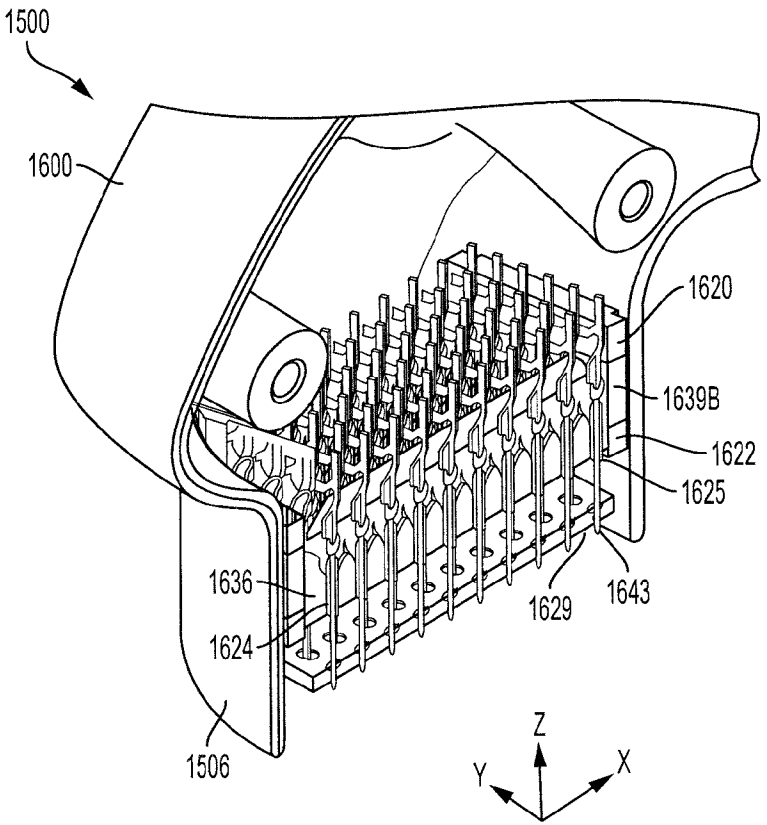
FIG. 18A is a cross-sectional view of the plug of FIG. 15 illustrating the pin protection plate of FIG. 17A in a disconnected position according to one or more embodiments described herein.

With reference now to FIG. 18A, the pin protection plate 1643 may protect the contacts 1624 when the plug 1500 is not connected to the receptacle 102. In some embodiments, the tips of the contacts 1624 may extend through the pin protection plate 1643 when the plug 1500 is not connected, the tips may be flush with the pin protection plate 1643 when the plug 1500 is not connected, and/or or the tips may be positioned away from the pin protection plate 1643 within the cavity 1601 when the plug 1500 is not connected. Thus, at most, only the tips of the contacts 1624 may be exposed beyond the pin protection plate 1643 and subject to damage from external forces.

With reference now to FIGS. 11, 18A and 18B, the mating end 1506 of the outer casing 1504 may be received by the gap 1103 between the outer shell 1104 and the mating surface 1106. As the mating end 1506 is forced further into the gap 1103, the mating surface 1106 resists movement of the pin protection plate 1643 relative to the mating end 1506. In that regard and with reference to FIGS. 11, 16, 18A and 18B, the T-bars 1648 allow movement of the pin protection plate 1643 relative to the rest of the plug 1500 (and the outer casing 1504). Thus, as the mating end 1506 is pushed further into the gap 1103, the pin protection plate 1643 moves in the positive Z direction relative to the rest of the plug 1500, further compressing the compression springs 1642. This allows the tips of the contacts 1624 to extend beyond the pin protection plate 1643 where they can be received by the apertures 1108 of the receptacle 1002. Stated differently, as the pin protection plate 1643 moves relative to the outer casing 1504 in the positive Z direction, the contact 1625 becomes more exposed proximate the mating end 1629. The plug 1500 may continue to be pushed into the receptacle 1002 until at least the tips of the contacts 1624 are received by the hyperboloid socket contacts 1003.

The static friction between the contacts 1624 and the hyperboloid socket contacts 1003 is sufficient to ensure that the plug 1500 remains connected to the receptacle 1002 until force is applied to the plug 1500 away from the receptacle 1002 (i.e., in the positive Z direction). However, the compression springs 1642 provide a negative unmating force between the plug 1500 and the receptacle 1002, reducing the amount of force necessary to disconnect the plug 1500 from the receptacle 1002.

In various embodiments and with reference to FIGS. 2, 5, 10 and 15, both of the connectors may be used to transmit X-ray images as well as MRI images. In order to use the connectors to transmit X-ray images, the interior of the plugs and/or receptacles should include a metal shielding surrounding the sockets, connectors, pins, and probes. For example, an internal surface of the outer casing 1504 of the plug 1500 and an internal surface of the body 1006 may be plated with metal, thus shielding the connector and allowing transmission of X-ray images. In some embodiments, these components can be fabricated from metal, or metal foil or tape may also be used to provide shielding.

Figure 19:
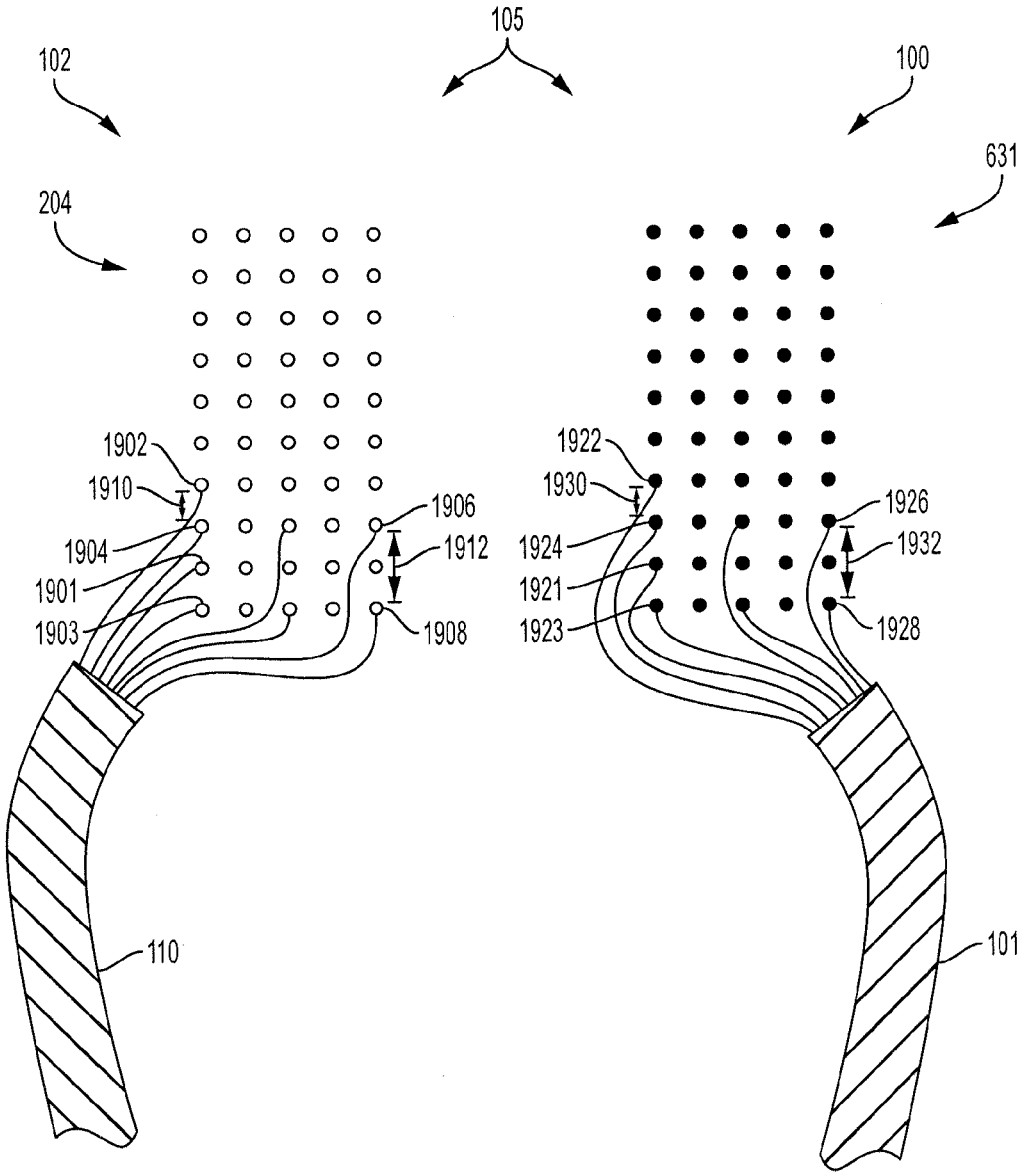
FIG. 19 is a connection diagram illustrating the connector of FIG. 1 configured to propagate single ended signals and differential pair signals according to one or more embodiments described herein.

With reference now to FIG. 19, the connector 105 including the receptacle 102 and the plug 100 may similarly be designed to transmit and/or receive any combination of single ended connections, differential pair connections, and/or other connections, at various voltages and frequencies. With brief reference to FIGS. 10 and 15, the receptacle 1002 and the plug 1500 may likewise be designed to transmit and/or receive any combination of connection types at various voltages and frequencies.

Returning to FIG. 19, the target contacts 204 of the receptacle 102 may be spaced an equal apart distance from each other. Similarly, the spring probe contacts 631 of the plug 100 may be spaced an equal distance apart from each other and aligned with the target contacts 204. However, various types of wires and/or sub-cables within the cable 110 and the cable 101 may be coupled to various target contacts 204 and spring probe contacts 631, resulting in various impedance values and allowing for impedance matching. Using impedance matching, the connector 105 may be customizable as a user can couple wires and/or sub-cables carrying various types of signals to select contacts to achieve a desired impedance value. In some embodiments, the connector 105 may be configured to transmit and receive signals of a single type, frequency, and voltage signal, and in some embodiments, the connector 105 may be configured to transmit and receive multiple signals of various types, frequencies, and/or voltages.

For example, the target contacts 204 include a target contact 1902 and a target contact 1904 that are adjacent each other and separated by a distance 1910. The target contact 1902 and the target contact 1904 may be coupled to wires/sub-cables used for a single ended connection having an impedance requirement of a first predetermined value. Similarly, the spring probe contacts 631 include a spring probe contact 1922 and a spring probe contact 1924 that are adjacent each other and separated by a distance 1930 that is substantially the same as the distance 1910. The spring probe contact 1922 and the spring probe contact 1924 maybe coupled to wires of the cable 101 for a single ended connection having an impedance requirement matching the predetermined value. Thus, when the plug 100 is coupled to the receptacle 102, a single ended signal can propagate through the connector 105 via the target contact 1902, target contact 1904, the spring probe contact 1922, and the spring probe contact 1924.

The target contacts 204 also include a target contact 1906 and a target contact 1908 that are non-adjacent and separated by a distance 1912. The distance 1912 may be greater than the distance 1910 such that the impedance between the target contact 1906 and the target contact 1908 may be greater than the impedance between the target contact 1902 and the target contact 1904. Thus, the target contact 1906 and the target contact 1908 may be coupled to wires of the cable 110 carrying a differential pair signal, which may have a greater impedance requirement. Similarly, the spring probe contacts 631 include a spring probe contact 1926 and a spring probe contact 1928 separated by a distance 1932 similar to the distance 1912, also having an impedance that allows propagation of differential pair signals. Thus, when connected, a differential pair signal can propagate through the connector 105.

In various embodiments, single ended signals and different pair signals may each be transmitted by adjacent pairs of target contacts 204 and spring probe contacts 631. For example, the target contact 1902 and the target contact 1904 may be coupled to wires of the cable 110 for a differential pair signal, and the target contact 1901 and the target contact 1903 may be coupled to wires of the cable 110 for a single ended signal. Similarly, the spring probe contact 1922 and the spring probe contact 1924 may be coupled to wires of the cable 101 for a differential pair signal, and the spring probe contact 1922 and the spring probe contact 1924 may be coupled to wires of the cable 101 for a single ended signal. This is possible due to the spacing of the contacts within the insulators of the plug 100 and the receptacle 102.

As described above, the distance between adjacent target contacts 204 and spring probe contacts 631 may be constant throughout the connector 105, yet the target contacts 204 and spring probe contacts 631 may be capable of carrying different types of signals. Additionally, the contacts of the connector 105 may be capable of transferring a multitude of non-radio frequency (RF) signals in additions to the single ended and differential pair signals described above. The receptacle 1002 and the plug 1500 may likewise be capable of transmitting and receiving various types of signals having various voltages and/or frequencies.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A connector for use in an environment exposed to liquids or debris comprising:

a receptacle having:

a body defining a plurality of apertures and having a mating face, and a plurality of socket contacts each defining an opening aligned with one of the plurality of apertures; and a plug having:

an outer casing defining a cavity and having a mating end, a plurality of contacts positioned within the cavity and coupled to the outer casing, each having a pin tip, and a pin protection plate slidably coupled to the outer casing, enclosing at least a portion of each of the plurality of contacts within the cavity, and defining a plurality of pin guides each aligned with one of the plurality of contacts such that when the mating end of the outer casing is aligned with the mating face of the body and force is applied to the outer casing towards the body, the mating face resists movement of the pin protection plate and the pin tip of each of the plurality of contacts extends beyond the pin protection plate and is received by one of the plurality of socket contacts via one of the plurality of apertures of the body.

2. The connector of claim 1, wherein each of the plurality of socket contacts is a stamped hyperboloid socket contact.

3. The connector of claim 1, wherein the receptacle further includes a contact retention plate coupled to a side of the body opposite the mating face and having a plurality of contact retention features each configured to receive and resist movement of one of the plurality of socket contacts relative to the contact retention plate.

4. The connector of claim 1, wherein each of the plurality of socket contacts has a termination end having at least one of a pin tip, a spring probe, or a contact surface and the body of the receptacle is configured to be coupled to a structure such that the at least one of the pin tip, the spring probe, or the contact surface allows for replacement of the receptacle without cutting wires.

5. The connector of claim 1, wherein the plug further includes:

a contact retention plate having a plurality of pin receivers each configured to receive and resist movement of one of the plurality of contacts relative to the contact retention plate; and an insulator positioned between the contact retention plate and the pin protection plate, coupled to the outer casing and the contact retention plate, and defining a plurality of apertures each aligned with one of the plurality of pin receivers such that each of the plurality of contacts can extend through one of the plurality of pin receivers and one of the plurality of apertures of the insulator.

6. The connector of claim 5, wherein:

the pin protection plate includes at least one T-bar extending towards the insulator and having an elongate portion and a cross portion, the insulator defines at least one slot configured to receive the elongate portion of the at least one T-bar such that the pin protection plate can move relative to the insulator by a distance substantially equal to a distance of the elongate portion, and the plug further includes at least one spring positioned between the pin protection plate and the insulator and configured to exert a separation force between the pin protection plate and the insulator.

7. The connector of claim 1, wherein each of the plurality of pin guides defines a funnel tapering towards the mating end of the outer casing, the funnel being configured to straighten the pin tip of one of the plurality of contacts as the pin tip extends through one of the plurality of pin guides.

8. The connector of claim 1, wherein the receptacle further includes elastic material positioned in each of the plurality of apertures of the body, the elastic material in each of the plurality of apertures defining an opening of a size that reduces the likelihood of liquid flowing therethrough and allows the opening to receive the pin tip of one of the plurality of contacts such that the pin tip deforms the elastic material and can extend through the opening.

9. The connector of claim 1, wherein each of the plurality of socket contacts includes a barb positioned adjacent the mating face of the body and configured to reduce the likelihood of fluid entering the cavity of the outer casing.

10. The connector of claim 1, wherein the body of the receptacle includes an outer shell and defines a gap between the outer shell and the mating face that is configured to receive the mating end of the outer casing of the plug.

11. The connector of claim 10, further comprising a protective cap configured to fit within the outer shell such that it reduces the likelihood of liquid contacting the mating face.

12. The connector of claim 1, wherein an adjacent pair of the plurality of contacts and a corresponding pair of socket contacts are configured to transmit a single ended signal and another adjacent pair of the plurality of contacts and another corresponding pair of socket contacts are configured to transmit a differential pair signal.

13. A connector for use in an environment exposed to liquids or debris comprising:

a receptacle configured to be coupled to a surface and having:

a body defining a plurality of apertures, having a mating face, and configured to be coupled to a structure, and a plurality of socket contacts each defining an opening aligned with one of the plurality of apertures and having a termination end having at least one of a pin tip, a spring probe, or a contact surface such that the at least one of the pin tip, the spring probe, or the contact surface allows for replacement of the receptacle without cutting wires;

a plurality of bed contacts each including at least one of bed socket contact, a target contact, a plated through hole, or a bed contact surface; and a plug having:

an outer casing defining a cavity and having a mating end, and a plurality of contacts positioned within the cavity and coupled to the outer casing, each having a pin tip configured to be received by the opening of one of the plurality of socket contacts.

14. The connector of claim 13, wherein the plug further includes a pin protection plate slidably coupled to the outer casing, enclosing at least a portion of each of the plurality of contacts within the cavity, and defining a plurality of pin guides each aligned with one of the plurality of contacts such that when the mating end of the outer casing is aligned with the mating face of the pin protection plate and force is applied to the outer casing towards the body, the mating face resists movement of the pin protection plate and the pin tip of each of the plurality of contacts extends beyond the pin protection plate and is received by one of the plurality of socket contacts via one of the plurality of apertures of the body.

15. The connector of claim 13, wherein each of the plurality of socket contacts is a stamped hyperboloid contact.

16. The connector of claim 13, wherein the receptacle further includes elastic material positioned in each of the plurality of apertures of the body, the elastic material in each of the plurality of apertures defining an opening of a size that reduces the likelihood of liquid flowing therethrough and allows the opening to receive the pin tip of one of the plurality of contacts such that the pin tip deforms the elastic material and the pin tip can extend through the opening.

17. A connector for use in an environment exposed to liquids or debris comprising:

a receptacle having:

a receptacle casing defining a plurality of contact apertures and having a mating surface, and a plurality of target contacts each having a contact surface and positioned in one of the plurality of contact apertures such that the contact surface is flush with the mating surface; and a plug having:

a plug casing defining a cavity, an insulator positioned with the cavity, coupled to the plug casing, having a mating face, and defining a plurality of probe apertures, and a plurality of spring probes each coupled to the insulator, having a mating end, and extending through one of the plurality of probe apertures such that the mating end extends outward from the mating face.

18. The connector of claim 17, wherein each of the plurality of target contacts has a termination end having at least one of a pin tip, a spring probe, or a contact surface and the receptacle casing is configured to be coupled to a structure such that the at least one of the pin tip, the spring probe, or the contact surface allows for replacement of the receptacle without cutting wires.

19. The connector of claim 17, wherein the receptacle casing defines a first receiving slot and a second receiving slot; and the plug also includes:

a latch actuation collar positioned within the cavity, slidably coupled to the plug casing, and having at least one latch actuator, and two latches each in contact with the latch actuation collar and having a receptacle lip configured to be received by one of the first receiving slot or the second receiving slot such that when the plug is connected to the receptacle and a force is applied to the at least one latch actuator in a direction away from the receptacle, the receptacle lip of each of the two latches is removed from the corresponding one of the first receiving slot or the second receiving slot.

20. The connector of claim 17, wherein each of the plurality of target contacts includes a barb for reducing the likelihood of the corresponding target contact becoming removed from the receptacle casing.

21. The connector of claim 17, wherein each of the plurality of target contacts includes a barb positioned adjacent the mating surface of the receptacle casing and configured to reduce the likelihood of fluid entering one of the plurality of contact apertures.

22. A connector for use in an environment exposed to liquids or debris comprising:

a receptacle having:

a receptacle casing having a mating surface, defining a plurality of contact apertures, and defining a first receiving slot and a second receiving slot, and a plurality of receptacle contacts each having a mating end and a termination end and positioned in one of the plurality of contact apertures; and a plug having:

a plug casing defining a cavity, a plurality of plug contacts each positioned within the cavity, coupled to the plug casing, and having a mating end configured to mate with the mating end of one of the plurality of receptacle contacts;

a latch actuation collar positioned within the cavity and slidably coupled to the plug casing; and two latches each in contact with the latch actuation collar and having a receptacle lip configured to be received by one of the first receiving slot or the second receiving slot such that when the plug is connected to the receptacle and the latch actuation collar is moved relative to the plug casing, the receptacle lip of each of the two latches is removed from the corresponding one of the first receiving slot or the second receiving slot.

23. The connector of claim 22, wherein the plug further includes an insulator positioned with the cavity, coupled to the plug casing, and defining a plurality of probe apertures such that each of the plurality of plug contacts is positioned within one of the plurality of probe apertures.

24. The connector of claim 23, wherein each of the two latches includes a collar lip and an inner rounded portion that is in contact with the insulator, and the latch actuation collar defines a first actuation slot and a second actuation slot each configured to receive the collar lip of one of the two latches such that in response to the movement of the latch actuation collar relative to the receptacle, the movement of the latch actuation collar causes each of the two latches to rotate relative to the insulator, removing the receptacle lip of each of the two latches from the corresponding one of the first receiving slot or the second receiving slot.

25. The connector of claim 22, wherein the plug includes at least one latch actuator coupled to the latch actuation collar and exposed by at least a portion of the plug casing such that movement of the at least one latch actuator relative to the plug casing causes movement of the latch actuation collar relative to the plug casing.

26. The connector of claim 22, wherein each of the plurality of receptacle contacts is a target contact and each of the plurality of plug contacts is a spring probe contact.

27. The connector of claim 22, wherein each of the plurality of receptacle contacts includes a sleeve contact having a spring probe sleeve, and a spring probe contact positioned in the spring probe sleeve, and wherein each of the plurality of plug contacts is a target contact.

28. The connector of claim 22, wherein each of the plurality of receptacle contacts includes a barb positioned adjacent the mating surface of the receptacle casing and configured to reduce the likelihood of fluid entering one of the plurality of contact apertures.

* * * * *